US010429787B2

(12) United States Patent
Kitajima

(10) Patent No.: US 10,429,787 B2
(45) Date of Patent: Oct. 1, 2019

(54) IMAGE FORMING APPARATUS WITH DETECTION OF SURFACE POTENTIAL OF PHOTOSENSITIVE MEMBER AND ADJUSTMENT OF SLOPE OF CHARGE POTENTIAL

(71) Applicant: CANON KABUSHIKI KAISHA, Tokyo (JP)

(72) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 15/664,419

(22) Filed: Jul. 31, 2017

(65) Prior Publication Data

US 2018/0046122 A1 Feb. 15, 2018

(30) Foreign Application Priority Data

Aug. 10, 2016 (JP) ..... 2016-157766

(51) Int. Cl.
*G03G 15/02* (2006.01)
*G03G 15/00* (2006.01)

(52) U.S. Cl.
CPC ..... *G03G 15/5016* (2013.01); *G03G 15/0233* (2013.01); *G03G 15/0266* (2013.01);
(Continued)

(58) Field of Classification Search
CPC ..... G03G 15/5016; G03G 15/0266; G03G 15/0291; G03G 15/5037
See application file for complete search history.

(56) References Cited

U.S. PATENT DOCUMENTS 5,659,839 A * 8/1997 Mizude ..... G03G 15/0266 399/50
6,963,708 B2 11/2005 Sekovski et al.
(Continued)

FOREIGN PATENT DOCUMENTS

JP 2005-084688 A 3/2005
JP 2007-212849 A 8/2007
(Continued)

OTHER PUBLICATIONS

U.S. Appl. No. 15/806,811, Kenichiro Kitajima, filed Nov. 8, 2017.
(Continued)

*Primary Examiner* — Benjamin R Schmitt
*Assistant Examiner* — Milton Gonzalez
(74) *Attorney, Agent, or Firm* — Venable LLP

(57) ABSTRACT

An image forming apparatus includes a movable photosensitive member, first and second corona chargers, an adjusting mechanism, a developing device, a detecting member configured to detect a surface potential of the photosensitive member at a plurality of positions with respect to the widthwise direction of the photosensitive member, an input portion, and a display portion. In accordance with input of an instruction to the input portion, the detecting portion detects at least two surface potentials of three surface potentials including the surface potential of the photosensitive member after being charged by the first and second corona chargers, the surface potential of the photosensitive member after being charged by the first corona charger, and the surface potential of the photosensitive member after being charged by the second corona charger. A detection result of the detecting member is displayed at the display portion.

7 Claims, 20 Drawing Sheets

(52) U.S. Cl.
CPC ..... *G03G 15/0291* (2013.01); *G03G 15/5037* (2013.01); *G03G 15/5062* (2013.01)

(56) References Cited

U.S. PATENT DOCUMENTS

| | | | | |
|---|---|---|---|---|
| 7,787,785 | B2 * | 8/2010 | Kidaka ..... | G03G 15/0258 399/38 |
| 2010/0322665 | A1 | 12/2010 | Oki | |
| 2015/0160578 | A1 | 6/2015 | Fukuda | |
| 2015/0160579 | A1 | 6/2015 | Hano et al. | |
| 2016/0161878 | A1 | 6/2016 | Kitajima | |

FOREIGN PATENT DOCUMENTS

| | | | |
|---|---|---|---|
| JP | 5317546 | B2 | 10/2013 |
| JP | 2015-114338 | A | 6/2015 |
| JP | 2016-109793 | A | 6/2016 |

OTHER PUBLICATIONS

U.S. Appl. No. 15/808,115, Kenichiro Kitajima, filed Nov. 9, 2017.
Communication dated Dec. 6, 2018, in European Patent Application No. 17184672.8.
Extended European Search Report dated Dec. 1, 2017, in European Patent Application No. 17184672.8.

* cited by examiner (a)

(b)

(a)

(b)

(a)

(b)

300

< DENSITY >

< CNDTN > CHRGNG 1 305

< RDNG > START 306

< RESULT > 307

| | F-DN. | R-DN. | ΔD | SIDE | AMOUNT |
|---|---|---|---|---|---|
| U | 0.500 | 0.650 | 0.15 | R | +1.0mm |
| U+L | 0.500 | 0.575 | 0.075 | R | – |
| L | – | – | 0.075 | R | +0.5mm |

Fig. 22

IMAGE FORMING APPARATUS WITH DETECTION OF SURFACE POTENTIAL OF PHOTOSENSITIVE MEMBER AND ADJUSTMENT OF SLOPE OF CHARGE POTENTIAL

FIELD OF THE INVENTION AND RELATED ART

The present invention relates to an image forming apparatus, of an electrophotographic type, such as a copying machine, a printer or a facsimile machine.

In the image forming apparatus of the electrophotographic type, as a charging means for electrically charging a photosensitive member (electrophotographic photosensitive member), a corona charger (hereinafter, also referred simply to as a "charger") has been widely used. In a constitution using the corona charger, in order to meet speed-up of image formation, Japanese Laid-Open Patent Application (JP-A) 2005-84688 has proposed a technique using a plurality of corona chargers and a plurality of grid electrodes.

In the case of the constitution using the corona charger, when there is a slope of electrostatic capacity of the photosensitive member, a distance between the charger and the photosensitive member, and the like with respect to a direction substantially perpendicular to a movement direction of a surface of the photosensitive member, a slope of a charge potential of the photosensitive member with respect to the direction generates in some instances. In the following, the direction (rotational axis direction of a drum-type photosensitive member) substantially perpendicular to the movement direction of the surface of the photosensitive member is also referred to as a "thrust direction". Further, the "slope" not only simply means the slope (inclination) but also is a concept including a "difference" between a plurality of positions with respect to the thrust direction.

A method of suppressing the slope of the charge potential with respect to the thrust direction and a method of adjusting the charge potential slope have been proposed. For example, JP-A 2007-212849 has proposed a method of adjusting a position of a charger in order to adjust a slope, with respect to the thrust direction, of a distance between the photosensitive member and a grid electrode of the charger. Further, Japanese Patent No. 5317546 has proposed a method of executing an operation in a mode in which a formed charge potential region is developed in order to adjust the slope of the charge potential with accuracy.

However, in the case of a constitution in which the photosensitive member is charged by forming a combined surface potential through superposition of charge potentials formed by chargers having different charging properties, it turned out that the following problem arose.

Incidentally, the "charging property" refers to a difference in absolute value of the charge potential formed individual chargers when the combined surface potential is formed, and the charging property of the charger for which the absolute value is relatively large is "higher" than the charging property of the charger for which the absolute value is relatively small.

That is, in the case of such a constitution, the charge potential of the charger having a relative high charging property has a large influence on a slope of the combined surface potential, and therefore, it is particularly important to adjust the charge potential by the charger having the relatively high charging property with accuracy. However, in the conventional methods, proper adjustment of the charge potentials cannot be carried out by individually grasping the slopes of the charge potentials of the respective chargers, particularly the slope of the charge potential by the charger having the relatively high charging property.

SUMMARY OF THE INVENTION

According to an aspect of the present invention, there is provided an image forming apparatus comprising: a movable photosensitive member; first and second corona chargers each extending along a widthwise direction crossing a movement direction of the photosensitive member at a position opposing said photosensitive member and each configured to electrically charge a surface of the photosensitive member, wherein the second corona charger is disposed downstream of the first corona charger with respect to the movement direction; an adjusting mechanism provided in each of the first and second corona chargers and capable of adjusting a slope of a charge potential of the photosensitive member with respect to the widthwise direction by an operator; a developing device provided downstream of the second corona charger with respect to the movement direction and configured to develop an electrostatic image on the photosensitive member into a toner image with toner deposited on the electrostatic image at a developing position; a detecting member provided downstream of the second corona charger and upstream of the developing position with respect to the movement direction and configured to detect a surface potential of the photosensitive member at a plurality of positions with respect to the widthwise direction of the photosensitive member; an input portion to which an instruction of the operator is inputted; and a display portion at which information is displayed, wherein in accordance with input of the instruction to the input portion, the detecting portion detects at least two surface potentials of three surface potentials including the surface potential of the photosensitive member after being charged by the first and second corona chargers, the surface potential of the photosensitive member after being charged by the first corona charger, and the surface potential of the photosensitive member after being charged by the second corona charger, and wherein a detection result of the detecting member is displayed at the display portion.

According to an aspect of the present invention, there is provided an image forming apparatus comprising: a movable photosensitive member; first and second corona chargers each extending along a widthwise direction crossing a movement direction of the photosensitive member at a position opposing said photosensitive member and each configured to electrically charge a surface of the photosensitive member, wherein the second corona charger is disposed downstream of the first corona charger with respect to the movement direction; an adjusting mechanism provided in each of the first and second corona chargers and capable of adjusting a slope of a charge potential of the photosensitive member with respect to the widthwise direction by an operator; a developing device provided downstream of the second corona charger with respect to the movement direction and configured to develop an electrostatic image on the photosensitive member into a toner image with toner deposited on the electrostatic image; an input portion to which an instruction of the operator is inputted; a display portion at which information is displayed; a test image forming portion configured to form test images in accordance with inclination of the instruction to the inclination portion by depositing the toner on the charged photosensitive member, transferring the test images onto a recording material and fixing the test images on the recording material, wherein the test image forming portion forms at least two test images of three test images including a first test image formed by depositing the toner on the photosensitive member charged by the first and second corona chargers, a second test image formed by depositing the toner on the photosensitive member charged only by the first corona charger, and a third test image formed by depositing the toner on the photosensitive member charged only by the second corona charger; an optical detecting member configured to detect light emitted to a plurality of positions of the recording material; and a controller configured to cause the display portion to display a detection result of the optical detecting member operated by the operator to detect the test images.

Further features of the present invention will become apparent from the following description of exemplary embodiments with reference to the attached drawings.

BRIEF DESCRIPTION OF THE DRAWINGS

FIG. 22 is a schematic view of a result screen displaying a measurement result or the like of the test image.

DESCRIPTION OF EMBODIMENTS

An image forming apparatus according to the present invention will be described specifically with reference to the drawings.

Embodiment 1

<1. Image Forming Apparatus>

<1-1. General Structure and Operation of Image Forming Apparatus>

Figure 1:
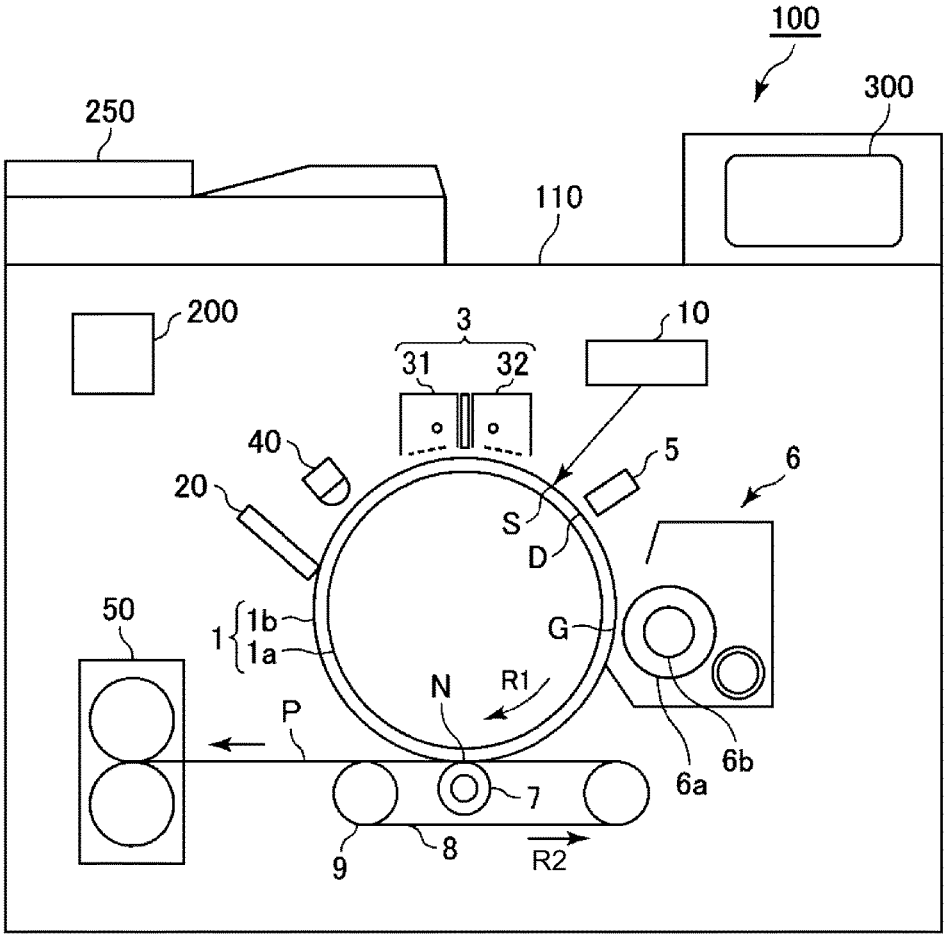
FIG. 1 is a schematic sectional view of an image forming apparatus.

FIG. 1 is a schematic sectional view of an image forming apparatus 100 in this embodiment. With respect to the image forming apparatus 100 and elements thereof, a front side of the drawing sheet of FIG. 1 is a "front side", and a rear side of the drawing sheet of FIG. 1 is a "rear side". A direction connecting the front side and the rear side is substantially parallel to a direction (thrust direction) substantially perpendicular to a surface movement direction of a photosensitive member 1 described later.

The image forming apparatus 100 includes the photosensitive member 1 as an image bearing member. The photosensitive member 1 is rotationally driven in an arrow R1 direction (clockwise direction) in FIG. 1 at a predetermined peripheral speed (process speed). The surface of the rotating photosensitive member 1 is electrically charged to a predetermined polarity (negative in this embodiment) and a predetermined potential by a charging device 3 as a charging means. That is, the charging device 3 forms a charge potential (non-exposed portion potential) on the surface of the photosensitive member 1. The surface of the charged photosensitive member 1 is subjected to scanning exposure to light by a display device 10 as an exposure means depending on image information, and an electrostatic image (electrostatic latent image) is formed on the photosensitive member 1. In this embodiment, a wavelength of the light emitted from the exposure device 10 is 670 nm, and an exposure amount on the surface of the photosensitive member 1 by the exposure device 10 is variable in a range of 0.1-0.5 $\mu J/cm^2$. The exposure device 10 adjusts the exposure amount depending on a developing condition, so that a predetermined exposed portion potential can be formed on the surface of the photosensitive member 1.

The electrostatic image formed on the surface of the photosensitive member 1 is developed (visualized) with toner as a developer by a developing device 6 as a developing means, so that a toner image is formed on the photosensitive member 1. In this embodiment, the photosensitive member surface is exposed to light after being charged, and thus an absolute value of the charge potential of the photosensitive member 1 lowers at an exposed portion of the photosensitive member 1, so that on the exposed portion, the toner charged to the same polarity as the charge polarity (negative in this embodiment) of the photosensitive member 1 (reverse development) can be selectively attached.

The image forming apparatus 100 includes a potential sensor 5 as a potential detecting means for detecting the surface potential of the photosensitive member 1. The potential sensor 5 is provided so as to be capable of detecting the surface potential of the photosensitive member 1 at a detecting position (sensor position) D between an exposure position S on the photosensitive member 1 by the exposure device 10 and a developing position G by the developing device 6. Control using the potential sensor 5 will be described later.

Figure 4:
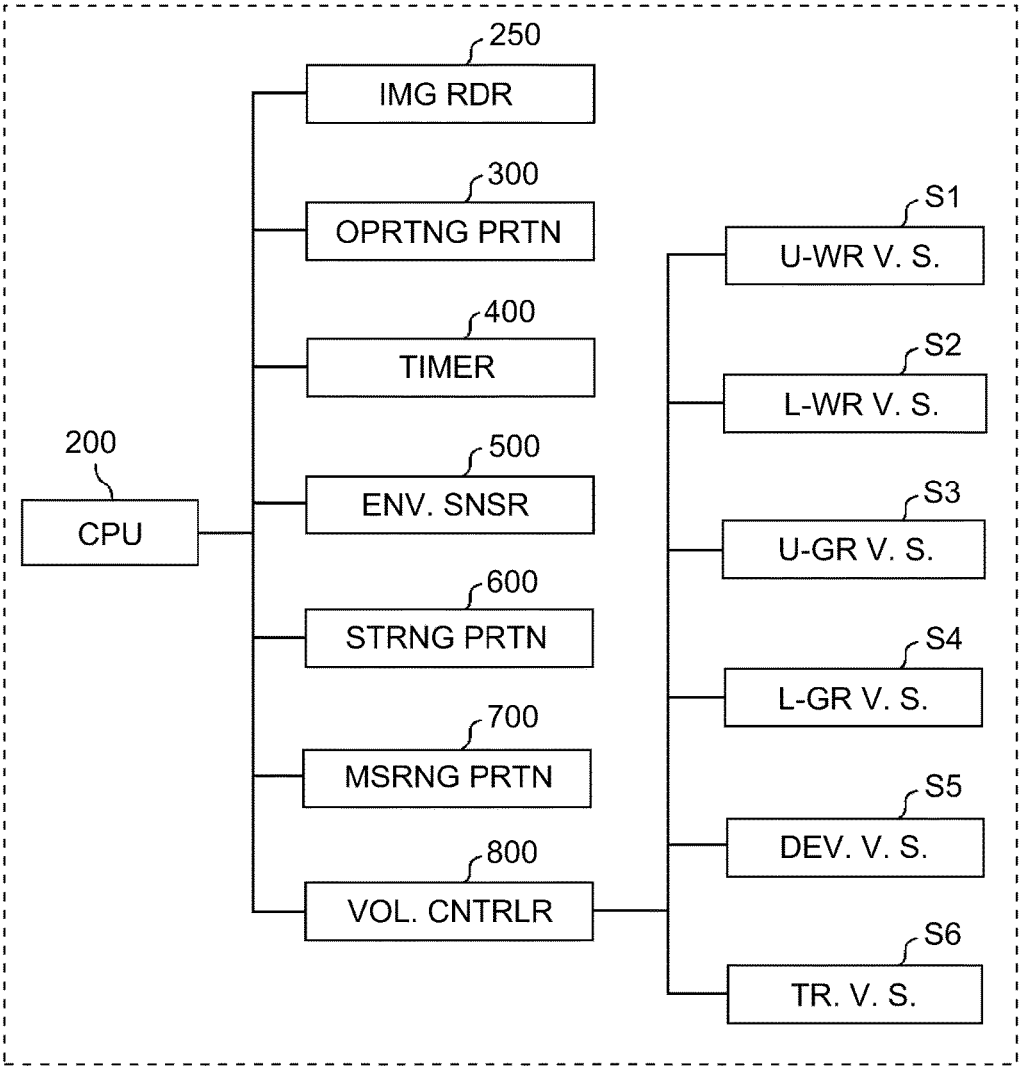
FIG. 4 is a block diagram showing a control mode of a principal part of the image forming apparatus.

A transfer belt 8 as a recording material carrying member is provided so as to oppose the photosensitive member 1. The transfer belt 8 is wound and stretched by a plurality of stretching rollers (supporting rollers), and of these stretching rollers, a driving force is transmitted by a driving roller 9, so that the transfer belt 8 is rotated (circulated and moved) in an arrow R2 direction in FIG. 1 at a peripheral speed which is the same as the peripheral speed of the photosensitive member 1. At an inner peripheral surface side of the transfer belt 8, at a position opposing the photosensitive member 1, a transfer roller 7 which is a roller type transfer member as a transfer means is provided. The transfer roller 7 is pressed against the transfer belt 8 toward the photosensitive member 1 and thus forms a transfer portion N where the photosensitive member 1 and the transfer belt 8 are in contact with each other. As described above, the toner image formed on the photosensitive member 1 is transferred, at the transfer portion N, onto a recording material P such as paper fed and carried by the transfer belt 8. During a transfer step, to the transfer roller 7, a transfer voltage (transfer bias) of an opposite polarity (positive in this embodiment) to a charge polarity of the toner during the development is applied from a transfer voltage source (high voltage source circuit) S6 (FIG. 4).

The recording material P on which the toner image is transferred is fed to a fixing device 50 as a fixing means and is heated and pressed by the fixing device 50, so that the toner image is fixed (melt-fixed) on the surface of the recording material P, and thereafter, the recording material P is discharged (outputted) to an outside of an apparatus main assembly 110 of the image forming apparatus 100.

On the other hand, the toner (transfer residual toner) remaining on the photosensitive member 1 after the transfer step is removed and collected from the surface of the photosensitive member 1 by a cleaning device 20 as a cleaning means. The surface of the photosensitive member 1 after being cleaned by the cleaning device 20 is irradiated with light (discharging light) by a light (optical)-discharging device 40 as a discharging means, so that at least a part of residual electric charges is removed. In this embodiment, the light-discharging device 40 includes an LED chip array as a light source. In this embodiment, a wavelength of the light emitted from the light-discharging device 40 is 635 nm, and an exposure amount of the surface of the photosensitive member 1 by the light-discharging device 40 is variable in a range of 1.0-7.0 $\mu J/cm^2$. In this embodiment, an initial value of the exposure amount by the light-discharging device 40 is set at 4.0 $\mu J/cm^2$.

Operations of the respective portions of the image forming apparatus 100 are subjected to integrated control by a CPU 200 as a controller (executing portion) provided in the apparatus main assembly 110. The image forming apparatus 100 includes an operating portion 300 having a function as an input portion for inputting various instructions and settings about a printing operation and a device adjusting operation and a function as a display portion for displaying various pieces of information. In this embodiment, the operating portion 300 is constituted by a touch-operable screen (touch panel). The image forming apparatus 100 further includes a reading portion 250 (optical detecting member) for optically reading an image on the medium such as paper and for permitting input to the CPU 200 after converting the read image into an electric signal.

<1-2. Photosensitive Member>

In this embodiment, the photosensitive member 1 is a cylindrical electrophotographic photosensitive member (photosensitive drum) including an electroconductive substrate 1*a* formed of aluminum or the like and a photoconductive layer (photosensitive layer) 1*b* formed on an outer peripheral surface of the substrate 1*a*. The photosensitive member 1 is rotationally driven by a driving motor (not shown) as a driving means. In this embodiment, the charge polarity of the photosensitive member 1 is negative. In this embodiment, the photosensitive member 1 is an amorphous silicon photosensitive member of 84 mm in outer diameter, and the photosensitive layer is 40 μm in thickness and 10 in dielectric constant.

The photosensitive member 1 is not limited to that in this embodiment, but for example, may also be an OPC (organic photoconductor). Further, the charge polarity thereof may also be different from that in this embodiment.

<1-3. Charging Device>

Figure 2:
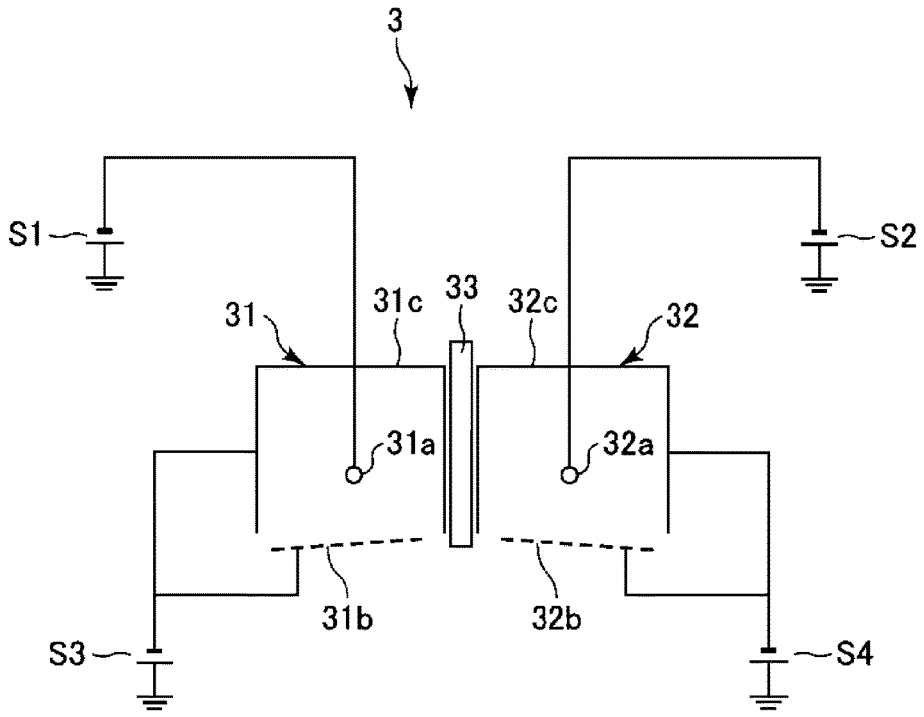
FIG. 2 is a schematic sectional view of a charging device.
Figure 3:
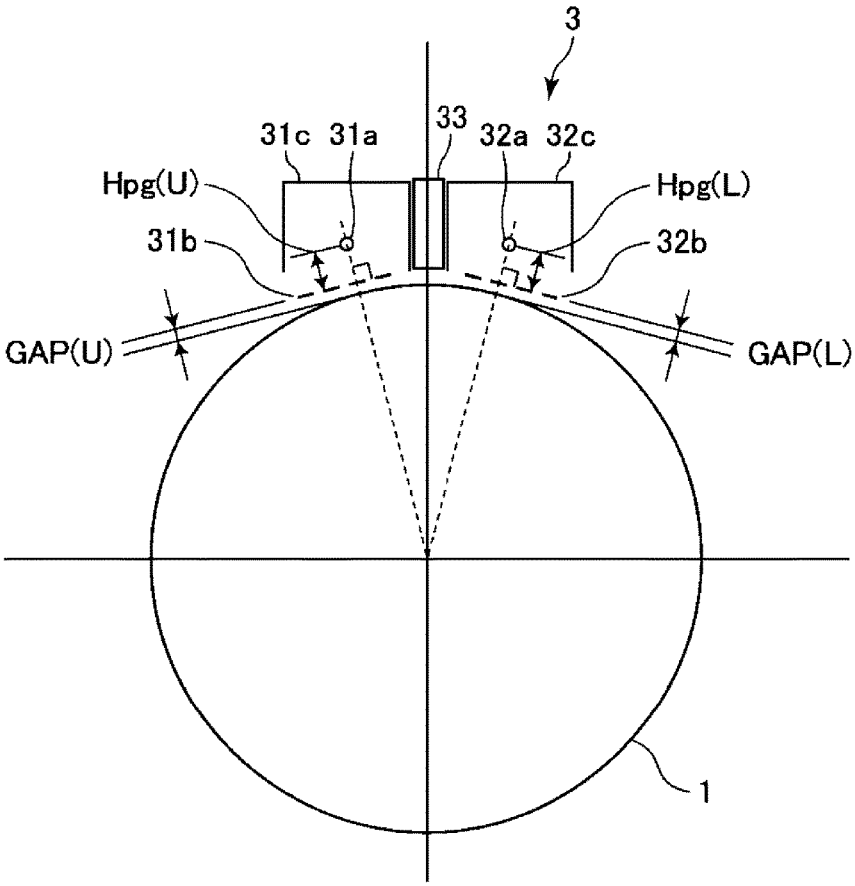
FIG. 3 is a schematic sectional view showing an arrangement of a grid electrode of a corona charger.

FIGS. 2 and 3 are schematic sectional views of the charging device 3 in this embodiment. In this embodiment, the charging device 3 is disposed above the photosensitive member 1.

The charging device 3 includes, as a plurality of corona chargers, an upstream(-side) charger (first charger) 31 provided at an upstream side with respect to a surface movement direction of the photosensitive member 1 and a downstream(-side) charger (second charger) 32 provided at a downstream side with respect to the surface movement direction. The upstream charger 31 and the downstream charger 32 are disposed adjacent to each other along the surface movement direction of the photosensitive member 1. The upstream charger 31 and the downstream charger 32 are scorotron chargers and are constituted so that charge voltages (charging biases, high charge voltages) applied thereto are independently controlled. In this embodiment, the upstream charger 31 is a main charging-side charger, so that a charging property is set so as to be higher for the upstream charger 31 than for the downstream charger 32. In this embodiment, the downstream charger 32 is a potential convergence-side charger, so that the charging property is set so as to be lower for the downstream charger 32 than for the upstream charger 31. In the following, elements relating to the upstream charger 31 and the downstream charger 32 are distinguished from each other by adding prefixes "upstream" and "downstream" in some instances.

The upstream charger 31 and the downstream charger 32 include wire electrodes (discharging wires, discharging wires) 31*a* and 32*a* as discharging electrodes, grid electrodes 31*b* and 32*b* as control electrodes, and shield electrodes 31*c* and 32*c* as shielding members (casings), respectively. Further, between the upstream charger 31 and the downstream charger 32, an insulating plate 33, which is an insulating member formed of an electrically insulating material, is provided. As a result, when different voltages are applied to the upstream shield electrode 31*c* and the downstream shield electrode 32*c*, generation of leakage between the upstream shield electrode 31*c* and the downstream shield electrode 32*c* is prevented. The insulating plate 33 is constituted by a plate-like member and is about 2 mm in thickness with respect to an adjacent direction (surface movement direction of the photosensitive member 1) between the upstream shield electrode 31*c* and the downstream shield electrode 32*c*.

A width of a discharging region (region where discharge for permitting charge of the photosensitive member 1 can be generated) of the charging device 3 with respect to the surface movement direction of the photosensitive member 1 is 44 mm, and a length of the discharging region with respect to a thrust direction is 340 mm. A width of the discharging region of each of the upstream charger 31 and the downstream charger 32 with respect to the surface movement direction of the photosensitive member 1 is 20 mm, i.e., the same.

Each of the upstream wire electrode 31*a* and the downstream wire electrode 32*a* is a wire electrode constituted by an oxidized tungsten wire. As a material of the wire electrode, a material which is 60 μm in line diameter (diameter) and which is ordinarily used in the image forming apparatus of the electrophotographic type was employed. Each of the upstream wire electrode 31*a* and the downstream wire electrode 32*a* is disposed so that an axial direction thereof is substantially parallel to the thrust direction, i.e., a rotational axis direction of the photosensitive member 1.

Each of the upstream grid electrode 31*b* and the downstream grid electrode 32*b* is a substantially flat plate-like grid electrode which is provided with a mesh-shaped opening formed by etching and which has a substantially rectangular shape elongated in one direction. As a material of the grid electrode, a material which is prepared by forming an anti-corrosion layer such as a nickel-plated layer on SUS (stainless steel) and which is ordinarily used in the image forming apparatus of the electrophotographic type was employed. Each of the upstream grid electrode 31*b* and the downstream grid electrode 32*b* is disposed so that a longitudinal direction thereof is substantially parallel to the thrust direction, i.e., the rotational axis direction of the photosensitive member 1. Further, as shown in FIG. 3, each of the upstream grid electrode 31*b* and the downstream grid electrode 32*b* is disposed by changing an arrangement angle (inclination angle) so that a planar direction thereof extends along curvature of the photosensitive member 1. The arrangement angle of each of the upstream grid electrode 31*b* and the downstream grid electrode 32*b* is substantially perpendicular to a rectilinear line connecting the associated one of the upstream grid electrode 31*b* and the downstream grid electrode 32*b* with a rotation center of the photosensitive member 1. Further, each of closest distances between the photosensitive member 1 and the upstream grid electrode 31*b* and between the photosensitive member 1 and the downstream grid electrode 32*b* (hereinafter, referred to as "grid gaps") GAP(U) and GAP(L), respectively, is set in a range of 1.3±0.2 mm. Further, each of distances between the upstream wire electrode 31*a* and the upstream grid electrode 31*b* and between the downstream wire electrode 32*a* and the downstream grid electrode 32*b* (hereinafter, referred to as "wire heights" Hpg(U) and Hpg(L), respectively, is set in a range of 8.0±1 mm. Further, the aperture ratio of the upstream grid electrode 31*b* and the downstream grid electrode 32*b* are set at 90% and 80%, respectively. Values of the aperture ratios are not limited to those in this embodiment, but may also be appropriately changed depending on, for example, a kind, a rotational speed, a charging condition, and the like of the photosensitive member 1.

Each of the upstream shield electrode 31*c* and the downstream shield electrode 32*c* is a substantially box-like member formed of an electroconductive material and is provided with an opening at a position opposing the photosensitive member 1. The upstream grid electrode 31*b* and the downstream grid electrode 32*b* are disposed at the openings of the upstream shield electrode 31*c* and the downstream shield electrode 32*c*, respectively.

<1-4. Charge Voltage>

As shown in FIG. 2, the upstream wire electrode 31*a* and the downstream wire electrode 32*a* are connected with an upstream wire voltage source S1 and a downstream wire voltage source S2, respectively, which are DC voltage sources (high voltage source circuits). As a result, voltages applied to the upstream wire electrode 31*a* and the downstream wire electrode 32*a* can be independently controlled. Further, the upstream grid electrode 31*b* and the downstream grid electrode 32*b* are connected with an upstream grid voltage source S3 and a downstream grid voltage source S4, respectively, which are DC voltage sources (high voltage source circuits). As a result, voltages applied to the upstream grid electrode 31*b* and the downstream grid electrode 32*b* can be independently controlled. In the following, the upstream wire voltage source S1, the downstream wire voltage source S2, the upstream grid voltage source S3 and the downstream grid voltage source S4 are collectively referred to as "charging voltage sources" in some cases. The charging voltage sources S1-S4 are examples of voltage applying means for applying voltages which can be independently controlled for the upstream charger 31 and the downstream charger 32, respectively.

The upstream shield electrode 31*c* and the downstream shield electrode 32*c* are connected with the upstream grid voltage source S3 and the downstream grid voltage source S4, respectively, and thus have the same potentials as those of the upstream grid electrode 31*b* and the downstream grid electrode 32*b*, respectively.

The upstream and downstream shield electrodes 31*c* and 32*c* are not limited to those having the same potentials as those of the upstream and downstream grid electrode 31*b* and 32*b*, respectively, but may also be electrically grounded by being connected with grounding electrodes of the apparatus main assembly 110. A constitution capable of independently controlling charge potentials formed on the surface of the photosensitive member 1 by the upstream charger 31 and the downstream charger 32 may only be required to be employed.

FIG. 4 is a block diagram showing a schematic control mode of a principal part of the image forming apparatus 100. To the CPU 200, a reading portion 250, an operating portion 300, a timer 400, an environment sensor 500, a surface potential measuring portion 700, a high voltage output controller 800, a storing portion 600 and the like are connected. The timer 400 measures a time. The environment sensor 500 measures at least one of a temperature and a humidity of at least one of an inside and an outside of the apparatus main assembly 110. The surface potential measuring portion 700 is a control circuit for controlling an operation of the potential sensor 5 under control of the CPU 200. The high voltage output controller 800 is a control circuit for controlling operations of the charge voltage sources S1-S4 and a developing voltage source S5 and a transfer voltage source S6 which are described later under control of the CPU 200. The storing portion 600 is a memory which is a storing means for storing programs and detection result of various detecting means, and stores, e.g., control data of the charge voltage and a measurement result of the surface potential of the photosensitive member 1. The CPU 200 carries out processes on the basis of the measurement result of the environment sensor 500 and information stored in the storing portion 600, and provides an instruction to the high voltage output controller 800, and thus controls the charge voltage sources S1-S4.

DC voltages applied to the upstream wire electrode 31*a* and the downstream wire electrode 32*a* (hereinafter, referred to as "wire voltages") are subjected to constant-current control so that values of currents flowing through the upstream wire electrode 31*a* and the downstream wire electrode 32*a* (hereinafter, referred to as "wire currents") are substantially constant at target current values. In this embodiment, the target current value of the wire current (primary current) is changeable in a range of −2000 to 0 μA. Further, DC voltages applied to the upstream grid electrode 31*b* and the downstream grid electrode 32*b* (hereinafter, referred to as "grid voltages") are subjected to constant-voltage control so that values of voltages (hereinafter, referred to as "grid voltages") are substantially constant at target voltage values. In this embodiment, the target voltage value of the grid voltage is changeable in a range of −1300 to 0 V.

<1-5. Developing Device>

In this embodiment, the developing device 6 is a developing device of a two-component magnetic brush type. The developing device 6 includes a hollow cylindrical developing sleeve 6*a* as a developer carrying member. The developing sleeve 6*a* is rotationally driven by a driving motor (not shown) as a driving means. Inside the developing sleeve 6*a*, i.e., at a hollow portion of the developing sleeve 6*a*, a magnet roller 6*b* as a magnetic field generating means is provided. The developing sleeve 6*a* carries a two-component developer containing toner (non-magnetic toner particles) and a carrier (magnetic carrier particles) by a magnetic force generated by the magnet roller 6*b*, and feeds the developer to an opposing portion (developing position) G to the photosensitive member 1 by being rotationally driven. During a developing operation, to the developing sleeve 6*a*, from the developing voltage source (high voltage source circuit) S5 (FIG. 4), a predetermined developing voltage (developing bias) is applied. The CPU 200 controls each of the charge potential (non-exposed portion potential) and an exposed portion potential of the photosensitive member 1 on the basis of a result of detection by the potential sensor 5 by controlling the developing voltage source S5. In this embodiment, a DC voltage output of the developing voltage source S5 is changeable in a range of −1000 V to 0 V.

The CPU 200 is capable of controlling the developing voltage source S5 depending on an image forming condition so that the toner image is formed on the surface of the photosensitive member 1 by depositing the toner on a portion with the exposed portion potential or a portion with the charge potential (non-exposed portion potential). During normal image formation, the CPU 200 controls the developing voltage source S5 so that the toner is deposited on the surface of the photosensitive member 1 at the portion with the exposed portion potential. Further, in the case where a test image for adjusting a slope (inclination) of the charge potential is formed as described later (Embodiment 4), the CPU 200 controls the developing voltage source S5 so that the toner is deposited on the surface of the photosensitive member 1 at the portion with the charge potential.

The developing device 6 may only be required to deposit the toner on the surface of the photosensitive member 1 at the portion with the exposed portion potential and the portion with the charge potential (Embodiment 4). The developing type, the charge polarity of the developer, and a relationship with the charge polarity of the photosensitive member 1 and the like are not limited to those in this embodiment. Further, in this embodiment, the developing voltage is the DC voltage, but an oscillating voltage in the form of superposition of a DC voltage (DC component) and an AC voltage (AC component) can also be used.

<2. Control of Charge Potential>

In this embodiment, the photosensitive member 1 is electrically charged by forming a combined surface potential by superposing charge potentials formed by independently controlling charge voltages applied to the upstream charger 31 and the downstream charger 32. In the following, the charging process by the charging device 3 will be further described.

As regards symbols or numerals showing the potentials, the voltages, the currents, the members, dimensions and the like, the symbols are distinguished from each other by adding "U" to the symbols relating to the upstream charger 31 and "L" to the symbols relating to the downstream charger 32, respectively, in some cases. Further, as regards the symbols showing the potentials, the potentials are distinguished from each other by adding "sens" to the symbols relating a sensor position D and "dev" to the symbols relating to the developing position G, respectively, with respect to the rotational direction of the photosensitive member 1 in some cases.

<2-1. Charge Potential by Upstream Charger>

First, a first charge potential (hereinafter, also referred to as an "upstream charge potential") Vd(U) which is the charge potential formed on the surface of the photosensitive member 1 by the upstream charger 31 will be described.

The upstream charge potential Vd(U) is controlled in the following manner. In a state in which an upstream wire voltage is applied to the upstream wire electrode 31*a* by the upstream wire voltage source S1 and thus a predetermined upstream wire current Ip(U) is supplied, an upstream grid voltage Vg(U) is applied to the upstream grid electrode 31*b* by the upstream grid voltage source S3.

Figure 5:
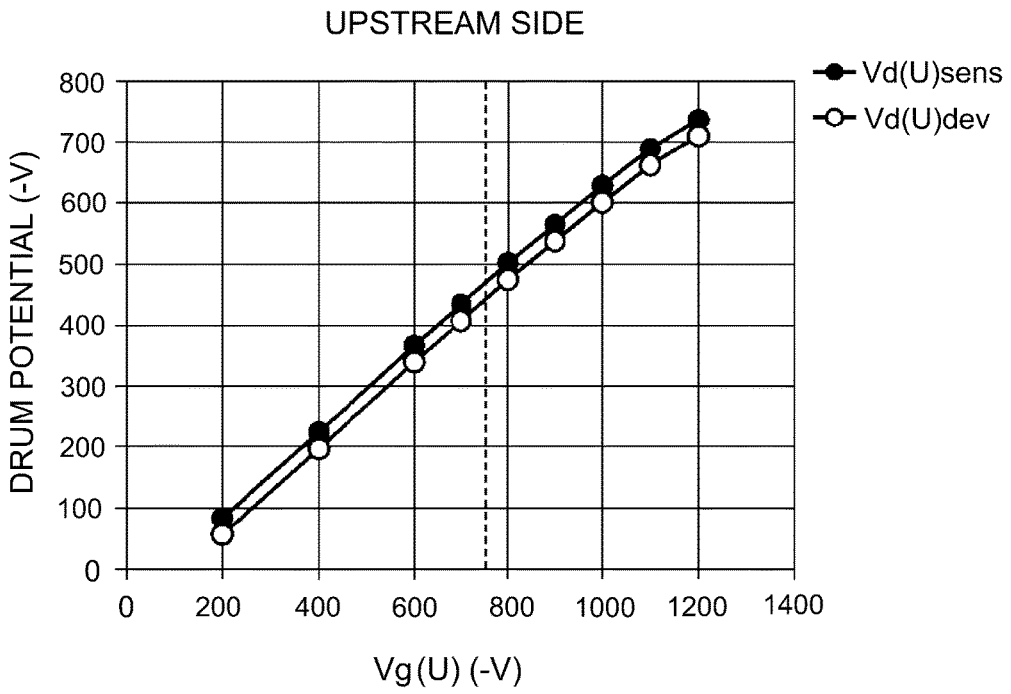
FIG. 5 is a graph showing a relationship between a charging voltage of an upstream charger and a charge potential of a photosensitive member.

FIG. 5 shows a relationship of the upstream grid voltage Vg(U) with upstream charge potentials Vd(U)sens and Vd(U)dev at the sensor position D and the developing position G, respectively, in the case where the peripheral speed of the photosensitive member 1 is 700 mm/sec. As shown in FIG. 5, the upstream charge potentials Vd(U) vary depending on the upstream grid voltage Vg(U). For example, in the case where the upstream wire current Ip(U) is −1600 μA, when the upstream grid voltage Vg(U) is −750 V, the upstream charge potential Vd(U)sens at the sensor position D is −480 V, and the upstream charge potential Vd(U)dev at the developing position G is −450 N. As regards the upstream grid voltage Vg(U), in order that the upstream charge potential Vd(U)dev at the developing position G is a target potential, the upstream charge potential Vd(U)sens at the sensor position D is controlled in consideration of a dark decay amount of the photosensitive member 1. In this embodiment, the upstream grid voltage Vd(U) is controlled so that the upstream charge potential Vd(U)dev at the developing position G falls within ±10 V of the target potential when the photosensitive member 1 is charged by the upstream charger 31 alone.

<2-2. Charge Potential by Downstream Charger>

Next, a second charge potential (hereinafter, also referred to as a "downstream charge potential") Vd(L), which is the charge potential formed on the surface of the photosensitive member 1 by the downstream charger 32, will be described.

The downstream charge potential Vd(L) is controlled in the following manner. In a state in which a downstream wire voltage is applied to the downstream wire electrode 32*a* by the downstream wire voltage source S2 and thus a predetermined downstream wire current Ip(L) is supplied, a downstream grid voltage Vg(L) is applied to the downstream grid electrode 32*b* by the downstream grid voltage source S4. As a result, the downstream charger 32 forms, on the surface of the photosensitive member 1, a combined surface potential Vd(U+L) in the form of the upstream charge potential Vd(U) superposed with the downstream charge potential Vd(L).

Figure 6:
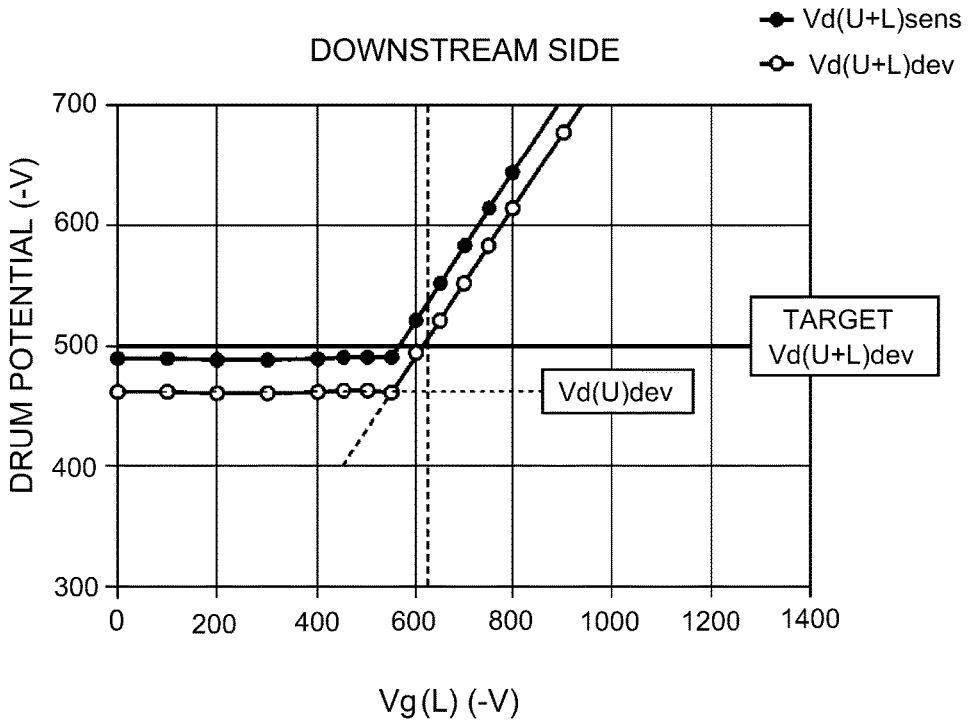
FIG. 6 is a graph showing a relationship between a charging voltage of a downstream charger and the charge potential of the photosensitive member.

FIG. 6 shows a relationship between the downstream grid voltage Vg(L) and the combined surface potential Vd(U+L) at the sensor position D and the developing position G in the case where the upstream charge potential Vd(U) is superposed with the downstream charge potential Vd(L). For example, in the case where the upstream charge potential Vd(U)dev at the developing position G is −460 V, when the downstream wire current Ip(L) is −1600 μA and the downstream grid voltage Vg(L) is −620 V, the combined surface potential Vd(U+L)dev at the developing position G is −500 V.

<2-3. Combined Surface Potential>

Next, a relationship among the upstream charge potential Vd(U), the downstream charge potential Vd(L) and the combined surface potential Vd(U+L) will be described.

Figure 7:
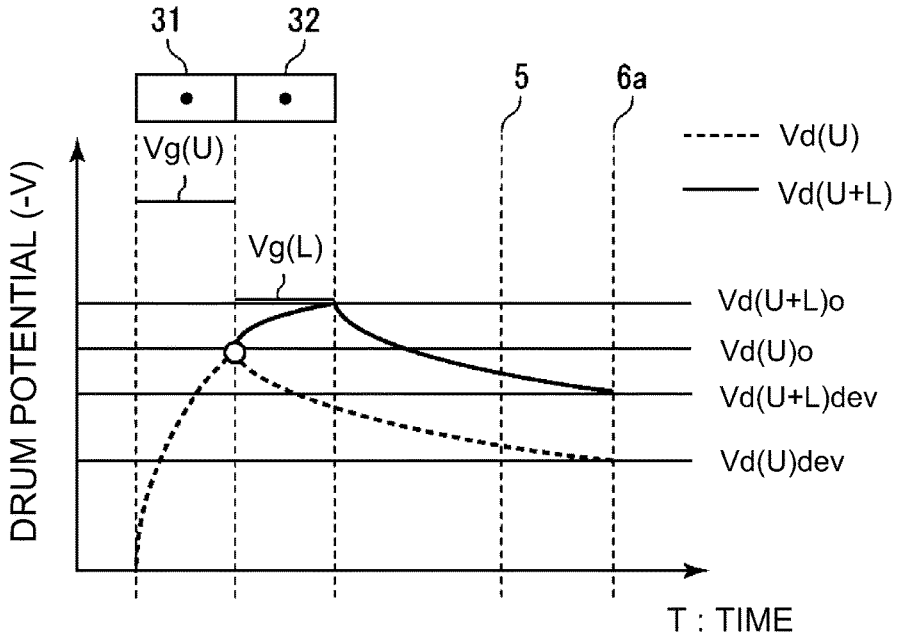
FIG. 7 is a graph showing a charge potential of the photosensitive member by each of the upstream and downstream chargers.

FIG. 7 is a schematic model view showing a change in surface potential of the photosensitive member 1 at a certain position from arrival at a position (discharging region) of the upstream charger 31 to the developing position G when the surface of the photosensitive member 1 is charged at the certain position by the upstream charger 31 and the downstream charger 32. In FIG. 7, a broken line represents the surface potential in the case where the photosensitive member surface is charged by the upstream charger 31 alone. In FIG. 7, a solid line represents the combined surface potential Vd(U+L) in the form of the upstream charge potential Vd(U) superposed with the downstream charge potential Vd(L).

As shown by the broken line in FIG. 7, in the case where the photosensitive member 1 is charged by the upstream charger 31 alone, the upstream charge potential Vd(U) starts a decay (attenuation) immediately after the certain position of the photosensitive member 1 passes through the upstream charger 31, and the upstream charge potential Vd(U)dev at the developing position G is −450 V, for example. Further, as shown by the solid line in FIG. 7, the combined surface potential Vd(U+L) formed by the downstream charger 32 starts a decay (attenuation) immediately after the certain position of the photosensitive member 1 passes through the downstream charger 32, and the downstream charge potential Vd(U+L)dev at the developing position G is −500 V, for example. Incidentally, in FIG. 7, "Vd(U)o" is the charge potential at the time of the end of the charging by the upstream charger 31, and "Vd(U+L)o" is the charge potential at the time of the end of the charging by the downstream charger 32.

As shown in FIG. 7, in this embodiment, the upstream charger 31 and the downstream charger 32 are different in charging property, and the charging property of the upstream charger 31 is higher than the charging property of the downstream charger 32.

<3. Adjusting Method of Slope of Charge Potential>

Next, an adjusting method of a slope of the photosensitive member 1 charge potential, with respect to the thrust direction, formed by the downstream charger 32 will be described.

In the case where the slope of the charge potential of the photosensitive member 1 is generated, the slope can be adjusted (corrected) by adjusting either one or both of the wire height Hpg and the grid gap GAP.

For convenience of explanation, as an example of the charge potential slope adjusting method, first, second and third adjusting methods are described, but as described later, in this embodiment, of these methods, the first method is employed.

<3-1. First Adjusting Method>

Figure 9:
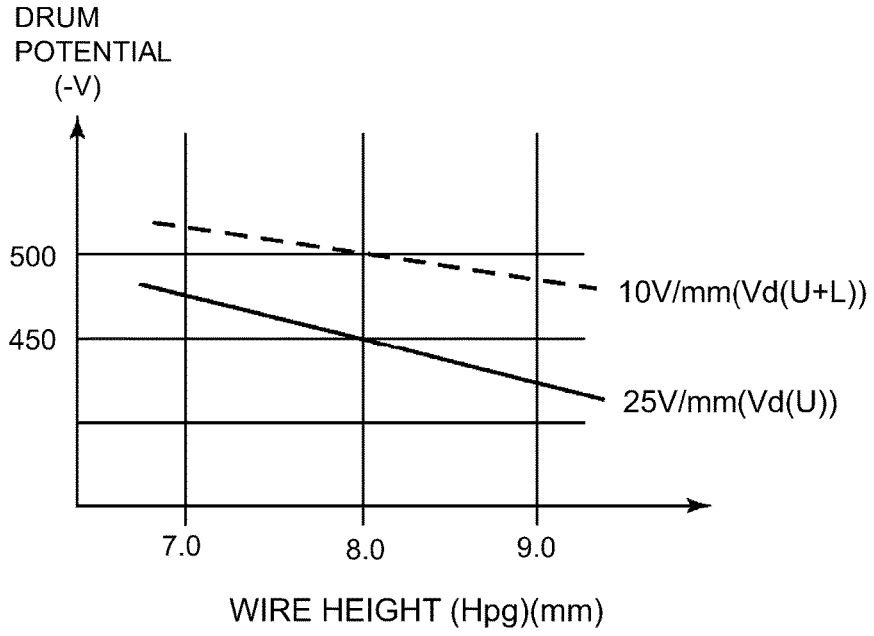
FIG. 9 is a graph showing a relationship between a wire height and the charge potential of the photosensitive member.

In the first adjusting method, the wire height Hpg is adjusted. FIG. 9 is a schematic side view of an adjusting mechanism 2 for realizing the first adjusting method. The adjusting mechanism 2 is an example of an adjusting means for adjusting the slope of the charge potential of the photosensitive member 1 formed by charging the photosensitive member 1 by the upstream charger 31 and the downstream charger 32 with respect to the thrust direction substantially perpendicular to the movement direction of the photosensitive member 1. The adjusting mechanism 2 in this embodiment independently adjusts wire heights Hpg(U) and Hpg (L) in the upstream charger 31 and the downstream charger 32, respectively. In this embodiment, the adjusting mechanism 2 for the upstream charger 31 and the adjusting mechanism 2 for the downstream charger 32 are substantially the same, and therefore, the adjusting mechanism 2 for the upstream charger 31 will be described as an example.

The upstream charger 31 includes a rear(-side) block 34R and a front(-side) block 34F which are supporting members for supporting the upstream wire electrode 31*a*, the upstream grid electrode 31*b* and the upstream shield electrode 31*c* (FIG. 2) at both end portions with respect to the thrust direction. The upstream wire electrode 31*a* is supported in a state in which tension is imparted to the rear block 34R and the front block 34F at both end portions with respect to an axial direction thereof by an urging means. Further, at positions of the rear block 34R and the front block 34F opposing the photosensitive member 1, supporting portions 35 for supporting the upstream grid electrode 31*b* are provided, so that the upstream grid electrode 31*b* is fixed to the supporting portions 35 at longitudinal end portions, respectively.

Figure 8:
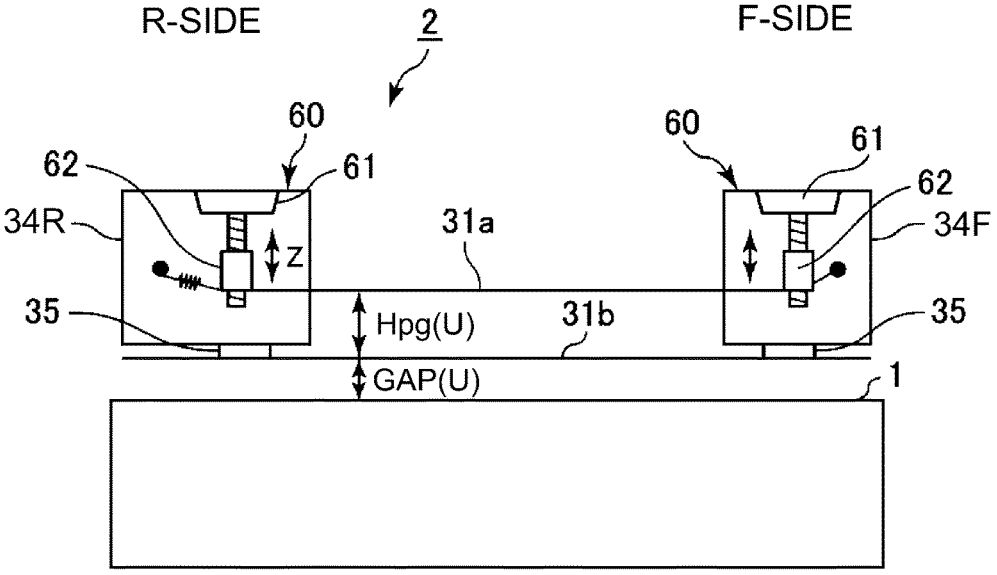
FIG. 8 is a schematic view showing an example of an adjusting mechanism of a slope of the charge potential.

An adjusting portion 60, for adjusting the wire height Hpg(U), constituting the adjusting mechanism 2 is provided in each of the rear block 34R and the front block 34F. The adjusting portion 60 is capable of adjusting the wire height Hpg(U) with respect to the thrust direction by independently adjusting the wire height Hpg(U) of the upstream wire electrode 31*a* with respect to the axial direction in the rear side and the front side depending on a charge potential slope direction. Each of the adjusting portions 60 in the rear side and the front side includes an adjusting screw 61 and a positioning member 62. The upstream wire electrode 31*a* is stretched in the axial direction by being contacted from below to the rear(-side) and front(-side) positioning members 62. By rotating the adjusting screw 61, the positioning member 62 is moved in a direction toward and away from the photosensitive member 1 as shown by an arrow Z in FIG. 8, so that the wire height Hpg(U) can be adjusted.

The upstream grid electrode 31*b* is supported by the supporting portion 35 as described above, so that even when the wire height Hpg(U) is adjusted, the grid gap GAP(U) is unchanged.

In this embodiment, the rear block 34R and the front block 34F may also be an integral (common) member for the upstream charger 31 and the downstream charger 32.

FIG. 9 is a graph showing a relationship between the wire height Hpg(U) and the charge potential of the photosensitive member 1. In FIG. 9, the abscissa represents the wire height Hpg (mm), and the ordinate represents the charge potential of the photosensitive member 1. In FIG. 9, a solid line shows a relationship between the wire height Hpg(U) in the upstream charger 31 and the upstream charge potential Vd(U). Further, in FIG. 9, a broken line shows a relationship between the wire height Hpg(L) in the downstream charger 32 and the downstream charge potential Vd(V+L).

As shown in FIG. 9, a slope of the upstream charge potential Vd(U) to the wire height Hpg(U) in the upstream charger 31 is 25 V/mm. Further, a slope of the combined surface potential Vd(U+L), which is superposition of the upstream charge potential Vd(U) with the downstream charge potential Vd(L), to the wire height Hpg(L) in the downstream charger 32 is 10 V/cm. Thus, the reason why the slope of the combined surface potential Vd(U+L) to the wire height Hpg(L) is smaller than the slope of the upstream charge potential Vd(U) to the wire height Hpg(U) is that the charging property of the upstream charger 31 is relatively high and the charging property of the downstream charger 32 is relatively low.

In the first adjusting method, in the case where the slope generates in each of the upstream charge potential Vd(U) and the combined surface potential Vd(U+L), on the basis of the relationships shown in FIG. 9, the wire heights Hpg(U) and Hpg(L) in the upstream and downstream chargers 31 and 32 can be independently adjusted. As a result, the slope of the upstream charge potential Vd(U) and the slope of the downstream charge potential Vd(L) can be independently adjusted.

The constitution in which the wire heights Hpg(U) and Hpg(L) in the upstream and downstream chargers 31 and 32 are independently adjusted is not limited to that in this embodiment. The constitution may only be required to be capable of independently adjusting the wire heights Hpg(U) and Hpg(L) while maintaining the grid gaps GAP(U) and GAP(L) in the upstream and downstream chargers 31 and 32 at certain values, respectively.

<3-2. Second Adjusting Method>

Figure 10:
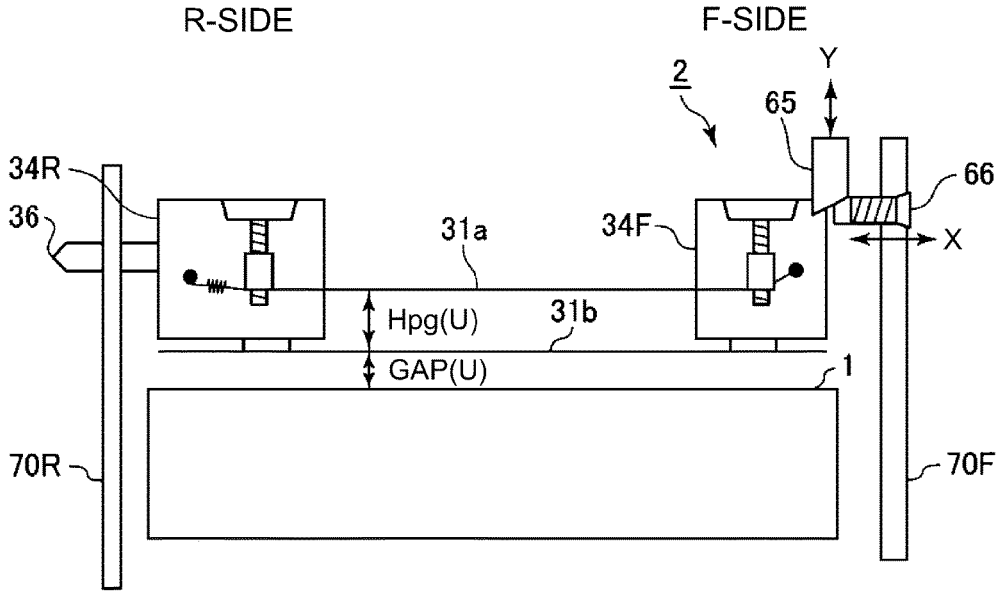
FIG. 10 is a schematic view showing another example of the adjusting mechanism of the slope of the charge potential.

In the second adjusting method, the grid gap GAP is adjusted. FIG. 10 is a schematic side view of an adjusting mechanism 2 for realizing the second adjusting method as another example of an adjusting means. In this embodiment, the adjusting mechanism 2 simultaneously adjusts the grid gaps GAP(U) and GAP(L) of the upstream and downstream chargers 31 and 32.

In this embodiment, the rear block 34R and the front block 34F are an integral (common) member for the upstream charger 31 and the downstream charger 32. FIG. 10 shows a state of the upstream charger 31 as seen from a side-surface side.

The rear side of the charging device 3 is positioned by engagement of a rear(-side) positioning portion 36 provided on the rear block 34R with a rear(-side) side plate 70R of the apparatus main assembly 110. On the front block 34F, a front(-side) positioning portion 65, for adjusting the grid gap GAP, constituting the adjusting mechanism 2 is provided. The front positioning portion 65 is configured to be contacted (mounted) from above to an adjusting member 66 mounted to a front(-side) side plate 70F of the apparatus main assembly 110. The adjusting member 66 is provided with a screw portion and can be moved toward the rear side or the front side along the thrust direction as shown by arrow X in FIG. 10 by rotating the screw portion. When the adjusting member 66 is moved in the arrow X direction, the front positioning portion 65 is moved in a direction toward and away from the photosensitive member 1 as shown by an arrow Y in FIG. 10. As a result, by moving the front positioning portion 65 by the adjusting member 66, the front block 34F is moved in the arrow Y direction in FIG. 10, so that the grid gaps GAP(U) and GAP(L) of the upstream and downstream chargers 31 and 32 (from the photosensitive member 1) can be simultaneously adjusted.

The upstream wire electrode 31*a* and the downstream wire electrode 32*a* are supported by the rear block 34R and the front block 34F in this embodiment similarly as in the first adjusting method described above. Further, even when the grid gaps GAP(U) and GAP(L) are adjusted, the wire heights Hpg(U) and Hpg(L) are unchanged.

Figure 11:
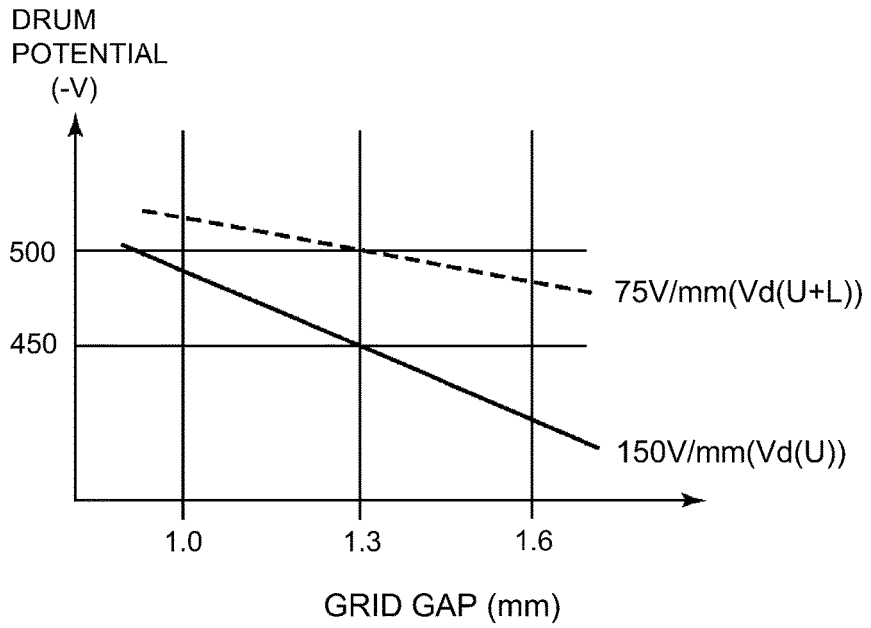
FIG. 11 is a graph showing a relationship between a grid gap and the charge potential of the photosensitive member.

FIG. 11 is a graph showing a relationship between the grid gap GAP and the charge potential of the photosensitive member 1. In FIG. 11, the abscissa represents the grid gap GAP, and the ordinate represents the charge potential of the photosensitive member 1. In FIG. 11, a solid line shows a relationship between the grid gap GAP(U) in the upstream charger 31 and the upstream charge potential Vd(U). Further, in FIG. 11, a broken line shows a relationship between the grid gap GAP(L) in the downstream charger 32 and the downstream charge potential Vd(V+L).

As shown in FIG. 11, a slope of the upstream charge potential Vd(U) to the grid gap GAP(U) in the upstream charger 31 is 150 V/mm. Further, a slope of the combined surface potential Vd(U+L), which is superposition of the upstream charge potential Vd(U) with the downstream charge potential Vd(L), to the grid gap GAP(L) in the downstream charger 32 is 75 V/cm. Thus, the reason why the slope of the combined surface potential Vd(U+L) to the grid gap GAP(L) is smaller than the slope of the upstream charge potential Vd(U) to the grid gap GAP(U) is that the charging property of the upstream charger 31 is relatively high and the charging property of the downstream charger 32 is relatively low.

In the second adjusting method, in the case where the slope generates in each of the upstream charge potential Vd(U) and the combined surface potential Vd(U+L), on the basis of the relationships shown in FIG. 11, the grid gaps GAP (U) and GAP(L) in the upstream and downstream chargers 31 and 32 can be simultaneously adjusted. As a result, the slope of the upstream charge potential Vd(U) and the slope of the downstream charge potential Vd(L) can be simultaneously adjusted.

The constitution in which the grid gaps GAP(U) and GAP(L) in the upstream and downstream chargers 31 and 32 are simultaneously adjusted is not limited to that in this embodiment. The constitution may only be required to be capable of simultaneously adjusting the grid gaps GAP(U) and GAP(L) while maintaining the wire heights Hpg(U) and Hpg(L) in the upstream and downstream chargers 31 and 32 at certain values, respectively.

<3-3. Third Adjusting Method>

Figure 12:
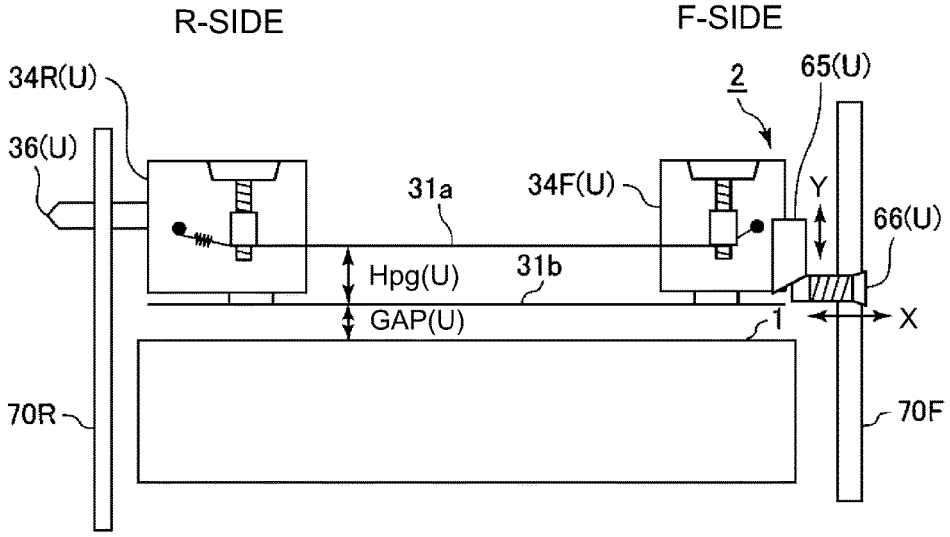
FIG. 12 is a schematic view showing a further example of the adjusting mechanism of the slope of the charge potential.

In the third adjusting method, the grid gap GAP is adjusted similarly as in the second adjusting method, but the grid gaps GAP(U) and GAP(L) of the upstream and downstream chargers 31 and 32 are independently adjusted. FIG. 12 is a schematic side view of an adjusting mechanism 2 for realizing the third adjusting method as a further example of an adjusting means. In this embodiment, the rear block 34R and the front block 34F are divided for the upstream charger 31 and the downstream charger 32. In this embodiment, the adjusting mechanism 2 independently adjusts positions of the front block 34F(U) of the upstream charger 31 and the front block 34F(L) of the downstream charger 32, and thus independently adjusts the grid gaps GAP(U) and GAP(L) of the upstream and downstream chargers 31 and 32. In this embodiment, the adjusting mechanisms for the upstream charger 31 and the downstream charger 32 are substantially the same, and therefore, the adjusting mechanism 2 for the upstream charger 31 will be described as an example.

The rear side of the upstream charger is positioned by engagement of a rear(-side) positioning portion 36(U) provided on the rear block 34R(U) with a rear(-side) side plate 70R of the apparatus main assembly 110. On the front block 34F(U) of the upstream charger 31, a front(-side) positioning portion 65(U), for adjusting the grid gap GAP, constituting the adjusting mechanism 2 is provided. The front positioning portion 65(U) is configured to be contacted (mounted) from above to an adjusting member 66(U) mounted to a front(-side) side plate 70F of the apparatus main assembly 110. The front positioning portion 65(U) and the adjusting member 66(U) have the same structures and functions as those described above with reference to FIG. 10, and moves the adjusting member 66(U) in an arrow X direction, so that the front positioning portion 65(U) can be moved in an arrow Y direction. As a result, the grid gaps GAP(U) and GAP(L) of the upstream and downstream chargers 31 and 32 (from the photosensitive member 1) can be independently adjusted.

The upstream wire electrode 31*a* and the downstream wire electrode 32*a* are supported by the rear block 34R and the front block 34F in this embodiment similarly as in the first adjusting method described above. Further, even when the grid gaps GAP(U) and GAP(L) are adjusted, the wire heights Hpg(U) and Hpg(L) are unchanged.

The constitution in which the grid gaps GAP(U) and GAP(L) in the upstream and downstream chargers 31 and 32 are independently adjusted is not limited to that in this embodiment. The constitution may only be required to be capable of independently adjusting the grid gaps GAP(U) and GAP(L) while maintaining the wire heights Hpg(U) and Hpg(L) in the upstream and downstream chargers 31 and 32 at certain values, respectively.

<4. Charging Mode for Measuring Slope of Charge Potential>

A charging process of the photosensitive member 1 performed in an operation in a measuring mode for adjusting the slopes of the charge potentials by the upstream and downstream chargers 31 and 32 will be described. In this embodiment, as a mode of the charging process in the operation in the measuring mode, the charging mode for independently measuring the slope of the charge potential and the slope of the combined surface potential by each of the upstream charger 31 and the downstream charger 32 will be described.

For convenience of explanation, as an example of the charging mode, first, second and third charging modes will be described, but as described later, in this embodiment, the first and second charging modes of these three charging modes are used.

<4-1. Setting of Charging Mode>

First, a setting method of the charging mode in the operation in the measuring mode will be described. In this embodiment, the image forming apparatus 100 executes the operation in the measuring mode depending on an instruction by an operator. The operator selects the charging mode through an operating portion 300 when the operation in the measuring mode is executed, so that the charging process of the photosensitive member 1 is executed. As shown in FIG. 4, the operating portion 300 is connected with the CPU 200, and the CPU 200 executes the charging process of the photosensitive member 1 in the respective charging modes in accordance with a condition set by the operator through the operating portion 300.

Figure 13:
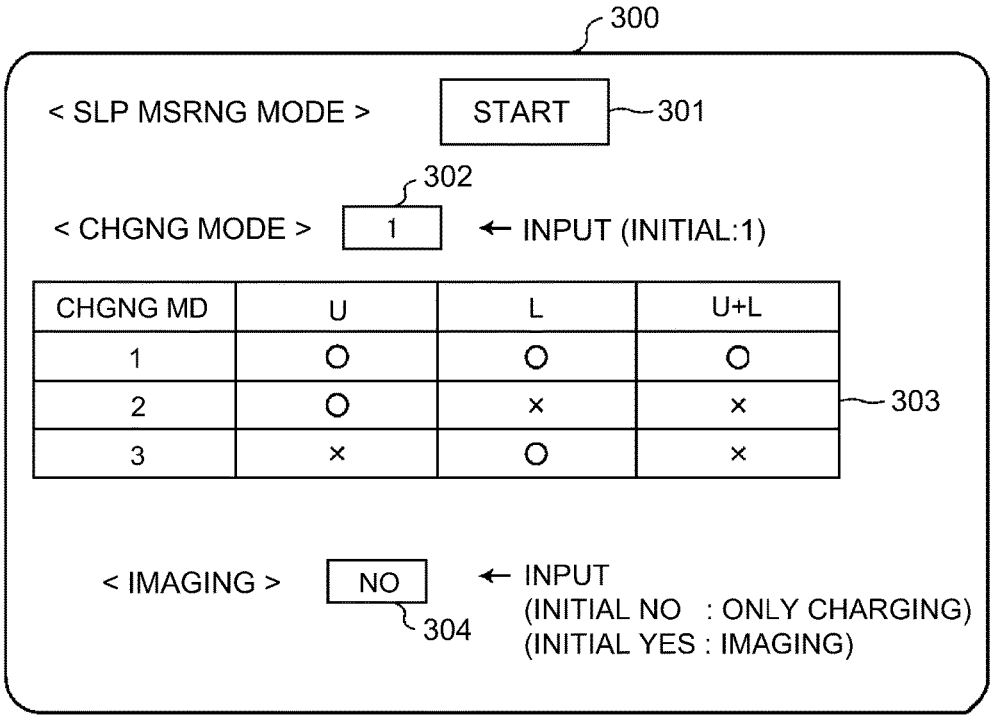
FIG. 13 is a schematic view of a setting screen where selection of a charging mode or the like is carried out.

FIG. 13 is a schematic view showing an example of a display (hereinafter also referred to as a "setting screen") at the operating portion 300 for selecting and executing the charging process in the charging mode in the operation in the measuring mode. The operator operates the operating portion 300 and causes the operating portion 300 to display the setting screen as shown in FIG. 13. The operator makes reference to a charging mode list 303 displayed at the operating portion 300, and inputs the number ("1", "2" and "3") of the charging mode, to be executed in the charging process, to a charging mode selection box 302, and then presses a start button 301. As a result, the CPU 200 causes the charging device 3 to execute the charging process of the photosensitive member 1 in the selected charging mode.

For convenience of explanation, in FIG. 13, an image formation selection box 304 used in the case (Embodiment 4) where the test image is formed by depositing the toner on the portion with the charge potential formed in each of the charging modes is shown, but this box 304 is not used in Embodiments 1 to 3 and therefore may be removed.

Further, constitutions of display contents and screens at the displaying portion 300 are not limited to those described above, but may also be changed to those in other embodiments.

<4-2. First Charging Mode>

The first charging mode is a charging mode in which first, the charge potential Vd(U) is formed by the upstream charger 31 and then the combined surface potential Vd(U+L) is formed by the upstream charger 31 and the downstream charger 32.

Figure 14:
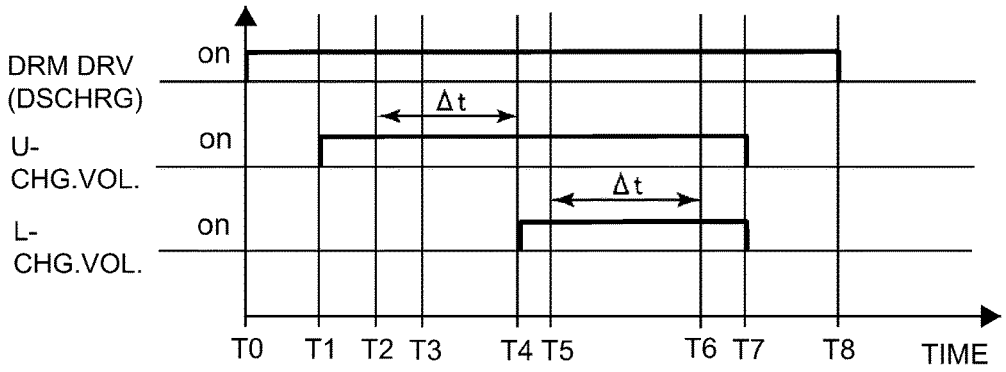
In FIG. 14, (a) and (b) are timing charts of an operation in a first charging mode.
Figure 14:
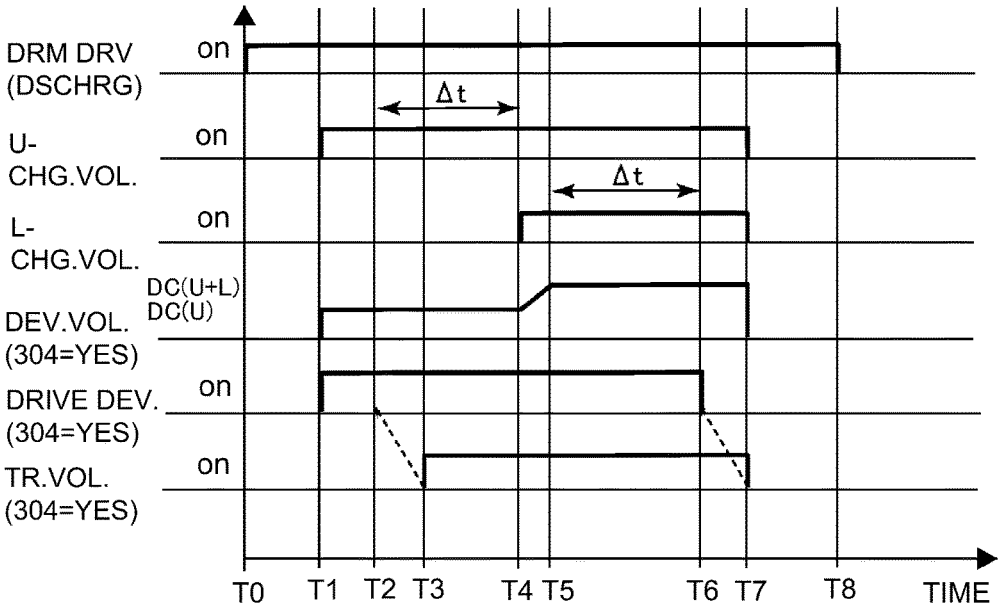

In FIG. 14, (a) and (b) are timing charts of the charging process in the charging mode. In the case where the first charging mode is selected as described above, the CPU 200 causes the charging device 3 to execute the charging process of the photosensitive member 1 in accordance with the timing charts of (a) and (b) of FIG. 14. In FIG. 14, (a) is the timing chart in the case where the charge potential of the photosensitive member 1 is measured using an electrometer (described later) for adjustment, provided at the developing position G, in the operation in the measuring mode (Embodiments 1 to 3). In FIG. 14, (b) is the timing chart in the case where the test image is formed in the operation in the measuring mode (Embodiment 4). In this embodiment, with reference to (a) of FIG. 14, the first charging mode will be described.

First, at timing T0, drive of the photosensitive member 1 is started. At this timing, in synchronism with the start of the drive of the photosensitive member 1, turning-on of the light discharging device 40 is also started. Then, at timing T1, application of an upstream grid voltage to the upstream charger 31 and supply of an upstream wire current to the upstream charger 31 are started with a predetermined interval (not shown). Thereafter, during a predetermined time Δt for measuring the charge potential from timing T2 to timing T4 in which the charge potential of the photosensitive member 1 is stable, the charge potential Vd(U) by the upstream charger 31 is formed. Then, at timing T4, application of a downstream grid voltage to the downstream charger 32 and supply of a downstream wire current to the downstream charger 31 are started with a predetermined interval (not shown). Thereafter, during a predetermined time Δt for measuring the charge potential from timing T5 to timing T6 in which the charge potential of the photosensitive member 1 is stable, the combined surface potential Vd(U+L) by the upstream charger 31 and the downstream charger 32 is formed. Thereafter, at timing T7, the application of the charge voltage to the upstream charger 31 and the downstream charger 32 is stopped, and at timing T8, the drive of the photosensitive member 1 is stopped.

Thus, in the charging process in the first charging mode, the upstream charge potential Vd(U) and the combined surface potential Vd(U+L) are independently formed, so that the respective potentials can be measured.

<4-3. Second Charging Mode>

The second charging mode is a charging mode in which first, the charge potential Vd(U) by the upstream charger 31 is formed alone.

Figure 15:
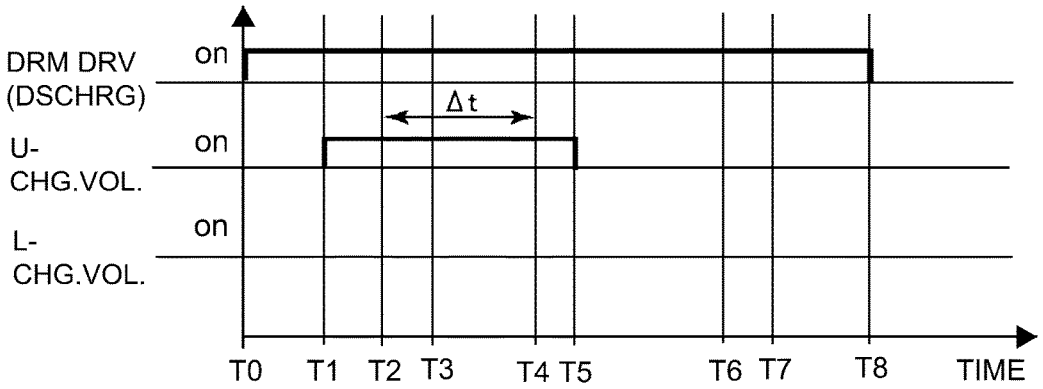
In FIG. 15, (a) and (b) are timing charts of an operation in a second charging mode.
Figure 15:
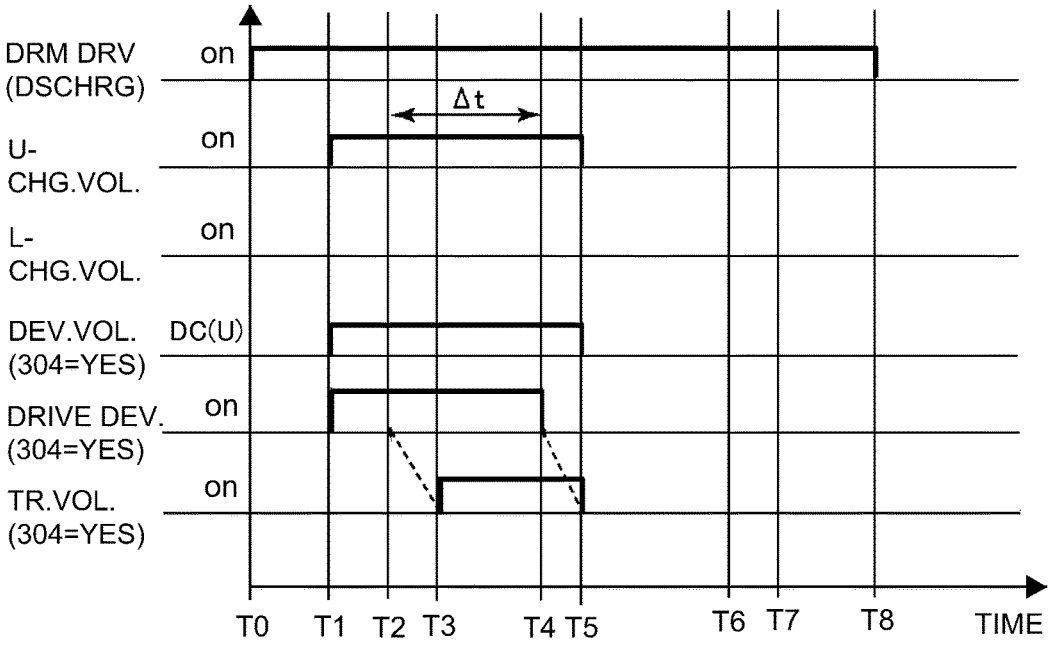

In FIG. 15, (a) and (b) are timing charts of the charging process in the charging mode. In the case where the second charging mode is selected as described above, the CPU 200 causes the charging device 3 to execute the charging process of the photosensitive member 1 in accordance with the timing charts of (a) and (b) of FIG. 15. Similarly as in the case of FIG. 14, in FIG. 15, (a) is the timing chart in Embodiments 1 to 3 and (b) is the timing chart in Embodiment 4. In this embodiment, with reference to (a) of FIG. 15, the second charging mode will be described.

First, at timing T0, drive of the photosensitive member 1 is started. At this timing, in synchronism with the start of the drive of the photosensitive member 1, turning-on of the light discharging device 40 is also started. Then, at timing T1, application of an upstream grid voltage to the upstream charger 31 and supply of an upstream wire current to the upstream charger 31 are started with a predetermined interval (not shown). Thereafter, during a predetermined time Δt for measuring the charge potential from timing T2 to timing T4 in which the charge potential of the photosensitive member 1 is stable, the charge potential Vd(U) by the upstream charger 31 is formed. Thereafter, at timing T5, the application of the charge voltage to the upstream charger 31 is stopped, and at timing T8, the drive of the photosensitive member 1 is stopped.

Thus, in the charging process in the second charging mode, the upstream charge potential Vd(U) is independently formed, so that the potential can be measured.

<4-4. Third Charging Mode>

The third charging mode is a charging mode in which first, the charge potential Vd(L) by the downstream charger 32 is formed alone.

Figure 16:
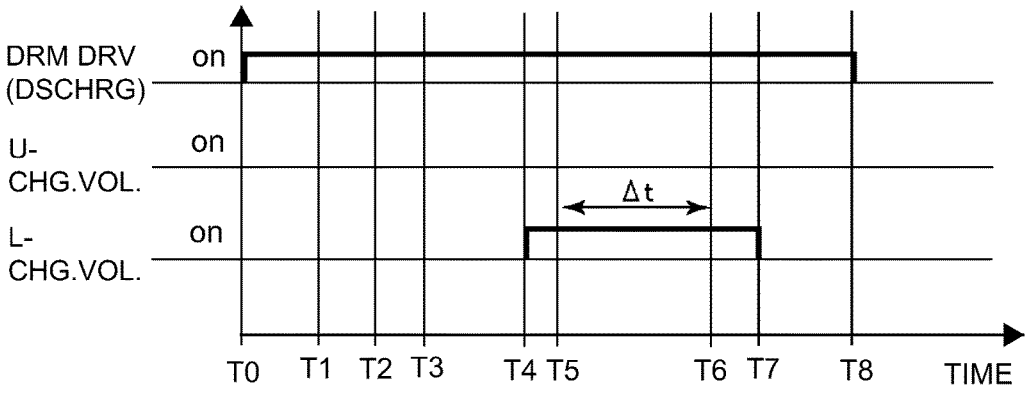
In FIG. 16, (a) and (b) are timing charts of an operation in a third charging mode.
Figure 16:
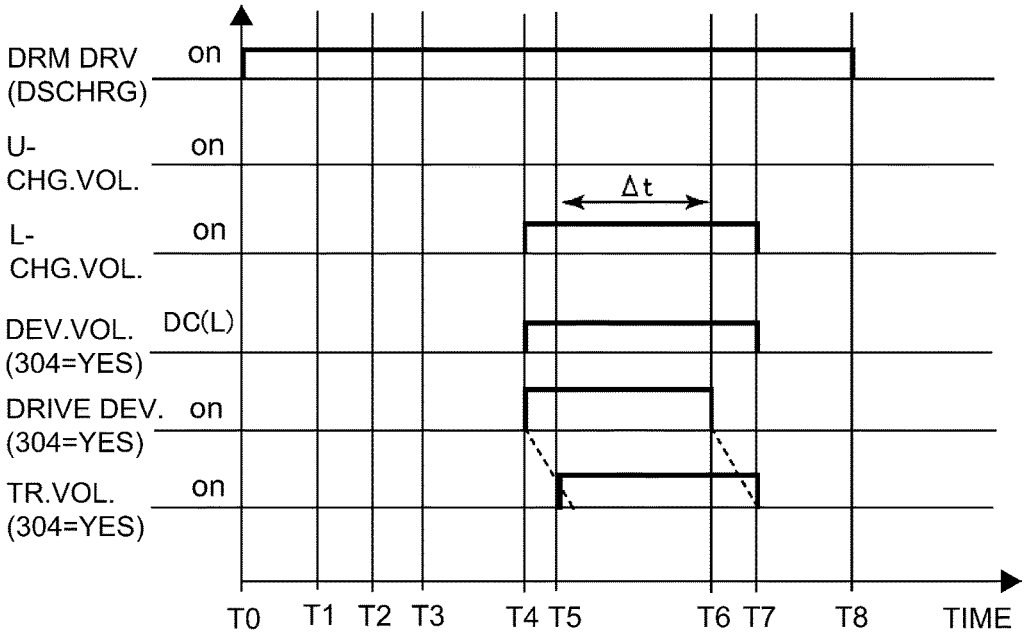

In FIG. 16, (a) and (b) are timing charts of the charging process in the charging mode. In the case where the third charging mode is selected as described above, the CPU 200 causes the charging device 3 to execute the charging process of the photosensitive member 1 in accordance with the timing charts of (a) and (b) of FIG. 16. Similarly as in the case of FIG. 14, in FIG. 16, (a) is the timing chart in Embodiments 1 to 3, and (b) is the timing chart in Embodiment 4. In this embodiment, with reference to (a) of FIG. 16, the third charging mode will be described.

First, at timing T0, drive of the photosensitive member 1 is started. At this timing, in synchronism with the start of the drive of the photosensitive member 1, turning-on of the light discharging device 40 is also started. Then, at timing T4, application of a downstream grid voltage to the downstream charger 32 and supply of a downstream wire current to the downstream charger 32 are started with a predetermined interval (not shown). Thereafter, during a predetermined time Δt for measuring the charge potential from timing T5 and timing T6 in which the charge potential of the photosensitive member 1 is stable, the charge potential Vd(L) by the downstream charger 32 is formed. Thereafter, at timing T7, the application of the charge voltage to the downstream charger 32 is stopped, and at timing T8, the drive of the photosensitive member 1 is stopped.

Thus, in the charging process in the third charging mode, the downstream charge potential Vd(L) is independently formed, so that the potential can be measured.

<4-5. Measuring Time and Kind of Charging Mode>

The above-described predetermined times (measuring times) Δt for measuring the charge potentials in the respective charging modes can be arbitrarily set depending on desired measurement accuracy of the charge potentials. For example, in the case where the charge potentials are measured by disposing the electrometer for adjustment at the developing position G, from the viewpoint of the measurement accuracy or the like, the measurement time Δt may desirably be set at a time of one turn or more of the photosensitive member 1. Further, at the operating portion 300 shown in FIG. 13, a constitution capable of adjusting the predetermined time Δt may also be employed.

Further, the kind of the charging modes is not limited to the three kinds described above, but may also be increased and decreased depending on the number of the chargers and the constitution of the image forming apparatus 100, and the like. However, it is desirable that the charging mode in which the charge potential by at least the charger, of the plurality of chargers, which has a largest influence on the slope of the charge potential and which a highest charging property can be independently measured is included. Further, it is desirable that the charging mode in which the charge potential by the charger having the relatively low charging property or the combined surface potential by all of the chargers can be independently measured is further included.

<5. Adjusting Procedure of Slope of Charge Potential>

Next, a procedure of adjusting the slope of the charge potential of the photosensitive member 1 by executing the operation in the measuring mode in this embodiment will be described. In this embodiment, as the charging mode in the operation in the measuring mode, the first and second charging modes described above with reference to (a) of FIG. 14 and (a) of FIG. 15 are used. Further, in this embodiment, as an adjusting procedure (method) of the slope of the charge potential, the first adjusting method described above with reference to FIG. 8 is used.

Figure 17:
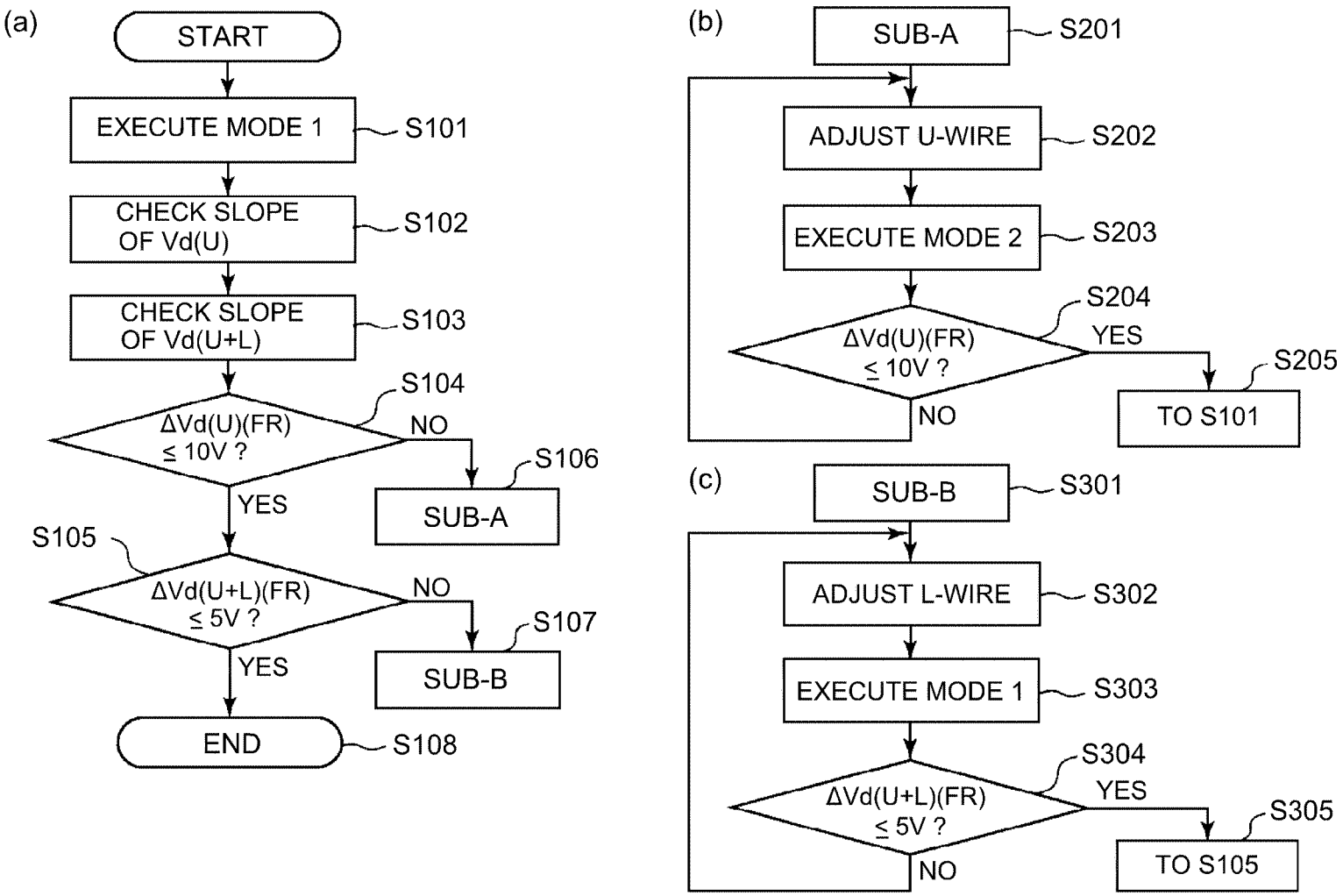
In FIG. 17, (a) to (c) are flowcharts showing an example of an adjusting procedure of the slope of the charge potential.

In FIG. 17, (a) to (c) are flowcharts showing a procedure of adjusting the slope of the charge potential in this embodiment. In the case where the charge potential slope is adjusted, the operator successively carries out measurement of the charge potential slope and adjustment of the charge potential slope in accordance with the procedures shown in (a) to (c) of FIG. 17.

First, the operator selects, in the procedure of (a) of FIG. 17, the first charging mode in the charging mode selection box 302 displayed at the operating portion 300 and then presses the start button 301, so that the charging process of the photosensitive member 1 in the first charging mode is executed (S101). Then, the operator measures each of the slope of the upstream charge potential Vd(U) and the slope of the combined surface potential Vd(U+L) (S102, S103).

The operator measures the slope of the charge potential by using the electrometer for adjustment as the potential detecting means disposed in advance at the developing position G. The electrometer may only be required to be capable of measuring the charge potential slope and can specifically be an electrometer capable of detecting the surface potential of the photosensitive member 1 at a plurality of positions in an image forming region (region in which the toner image can be carried) with respect to the thrust direction. As the electrometer, for example, a potential measuring jig, which is mounted in place of the developing device 6 in the apparatus main assembly 110 and which is constituted so as to be capable of detecting the surface potential of the photosensitive member 1 at the developing position G, can be used. The electrometer may be one including detecting portions for detecting the surface potential at a plurality of detecting positions with respect to the thrust direction or may also be one in which a single detecting portion is moved to the plurality of detecting positions in the thrust direction. The number of the plurality of detecting positions is arbitrary, but in order to measure the charge potential slope with sufficient accuracy, the number of the detecting positions may desirably be two or more positions in the rear side and the front side relative to the central side of the image forming region with respect to the thrust direction. In this embodiment, the electrometer detects the surface potential of the photosensitive member 1 at the two positions in the rear side and the front side relative to the central side with respect to the thrust direction. The results of detections are displayed on operating portion 300, in the same manner as in FIG. 22 of Embodiment 4, which will be described hereinafter, although the densities should read as surface potentials.

The operator checks whether or not the slope of the upstream charge potential Vd(U), specifically, a difference (FR difference) in charge potential between the front side and the rear side relative to the central side with respect to the thrust direction is not more than a predetermined threshold (not more than 10 V in this embodiment) (S104). In the case where the slope of the upstream charge potential Vd(U) is not more than the predetermined threshold, the operator causes the operation to go to a procedure of S105, and in the case where the slope of the upstream charge potential Vd(U) is larger than the predetermined threshold, the operator causes the operation to go to a procedure of SUB-A shown in (b) of FIG. 17 (S106, S201). The procedure of SUB-A is a procedure of adjusting the wire height Hpg(U) in the upstream charger 31 by the first adjusting method described above with reference to FIG. 8.

After the operation goes to the procedure of SUB-A shown in (b) of FIG. 17, the operator adjusts the wire height Hpg(U) in the upstream charger 31 on the basis of a relationship, shown in FIG. 9, between the wire height Hpg(U) in the upstream charger 31 and the slope of the upstream charge potential Vd(U) (S202). Thereafter, the operator selects the second charging mode in the charging mode selection box 302 displayed at the operating portion 300 and then presses the start button 301, so that the charging process of the photosensitive member 1 in the second charging mode is executed (S203). Then, the operator checks whether or not the slope (FR difference) of the upstream charge potential Vd(U) is not more than a threshold (S204). The operator repeats the procedures of S202-S204 until the slope of the upstream charge potential Vd(U) is not more than the threshold until the slope of the upstream charge potential Vd(U) is not more than the threshold in S204, and in the case where the slope is not more than the threshold, the operator ends the procedure of SUB-A, and the operation is returned to the procedure of S101 (S205).

Thereafter, the operator performs the procedures of S101-S103, and in the case where the slope of the upstream charge potential Vd(U) is not more than the threshold in S104, the operator checks whether or not the slope (FR difference) of the combined surface potential Vd(U+L) is not more than a predetermined threshold (not more than 5 V in this embodiment) (S105). In the case where the slope of the combined surface potential Vd(U+L) is not more than the predetermined threshold, the operator ends the procedure of adjusting the charge potential slope (S108). On the other hand, in the case where the slope of the combined surface potential Vd(U+L) is larger than the predetermined threshold, the operator causes the operation to go to a procedure of SUB-B shown in (c) of FIG. 17 (S107, S301). The procedure of SUB-B is a procedure of adjusting the wire height Hpg(L) in the downstream charger 32 by the first adjusting method described above with reference to FIG. 8.

After the operation goes to the procedure of SUB-B shown in (c) of FIG. 17, the operator adjusts the wire height Hpg(U) in the downstream charger 32 on the basis of a relationship, shown in FIG. 9, between the wire height Hpg(L) in the downstream charger 32 and the slope of the combined surface potential Vd(U+L) (S302).

Thereafter, the operator selects the first charging mode in the charging mode selection box 302 displayed at the operating portion 300 and then presses the start button 301, so that the charging process of the photosensitive member 1 in the first charging mode is executed (S303). Then, the operator checks whether or not the slope (FR difference) of the combined surface potential Vd(U+L) is not more than a threshold (S304). The operator repeats the procedures of S302-S304 until the slope of the combined surface potential Vd(U+L) is not more than the threshold, and in the case where the slope is not more than the threshold, the operator ends the procedure of SUB-B, and the operation is returned to the procedure of S105 (S305).

After the operation is returned to the procedure of S105 of (a) of FIG. 17, the operator checks whether or not the slope (FR difference) of the combined surface potential Vd(U+L) is not more than the predetermined threshold, and in the case where the slope (FR difference) is not more than the predetermined threshold, the operator ends the procedure of adjusting the charge potential slope (S108).

The adjustment by the adjusting mechanism 2 can be performed so that, for example, a potential smaller in absolute value of the charge potential is changed to a potential larger in absolute value of the charge potential or the potential larger in absolute value of the charge potential is changed to the potential smaller in absolute value of the charge potential. In either case, on the basis of the relationship shown in FIG. 9, a proper adjusting amount of the adjusting mechanism 2 can be acquired.

In this embodiment, by using the first and second charging modes, the slope of the upstream charge potential Vd(U) formed by the upstream charger 31 in a main charging side and the slope of the combined surface potential Vd(U+L) formed by the upstream charger 31 and the downstream charger 32 can be independently measured. Further, in this embodiment, by using the first adjusting method of the charge potential slope, the charge potential Vd(U) formed by the upstream charger 31 is independently adjusted, so that the potential can be adjusted substantially uniformly with respect to the thrust direction. Further, by independently adjusting the charge potential Vd(L) formed by the downstream charger 32 in a potential convergence side, the combined surface potential Vd(U+L) finally formed can be adjusted substantially uniformly with respect to the thrust direction.

In this embodiment, by using the first and second charging modes, the slope of the upstream charge potential Vd(U) and the slope of the combined surface potential Vd(U+L) were measured. Then, not only the wire height Hpg(U) of the upstream charger 31 was adjusted so that the upstream charge potential Vd(U) falls within a predetermined range but also the wire height Hpg(L) of the downstream charger 32 was adjusted so that the combined surface potential Vd(U+L) falls within a predetermined range. On the other hand, by using the second and third charging modes, the slope of the upstream charge potential Vd(U) and the slope of the downstream charge potential Vd(L) can also be independently measured. In this case, not only the wire height Hpg(U) of the upstream charger 31 can be independently adjusted so that the upstream charge potential Vd(U) falls within a predetermined range but also the wire height Hpg(L) of the downstream charger 32 can be independently adjusted so that the downstream charge potential Vd(L) falls within a predetermined range. As a result, consequently, the slope of the combined surface potential Vd(U+L) formed by superposition of the upstream charge potential Vd(U) and the downstream charge potential Vd(L) can be adjusted.

As described above, according to this embodiment, in the constitution in which the charging process of the photosensitive member 1 is carried out by forming the combined surface potential with use of the corona chargers 31 and 32 different in charging property, it becomes possible to improve accuracy of the adjustment of the slope of the charge potential of the photosensitive member 1.

Embodiment 2

Another embodiment of the present invention will be described. A basic structure and a basic operation of an image forming apparatus in this embodiment are the same as those in Embodiment 1. Accordingly, elements having the same or corresponding functions or structures as those in Embodiment 1 are represented by the same reference numerals or symbols and will be omitted from detailed description.

In this embodiment, as an adjusting procedure (method) of the slope of the charge potential, the third adjusting method described above with reference to FIG. 12 is used.

Figure 18:
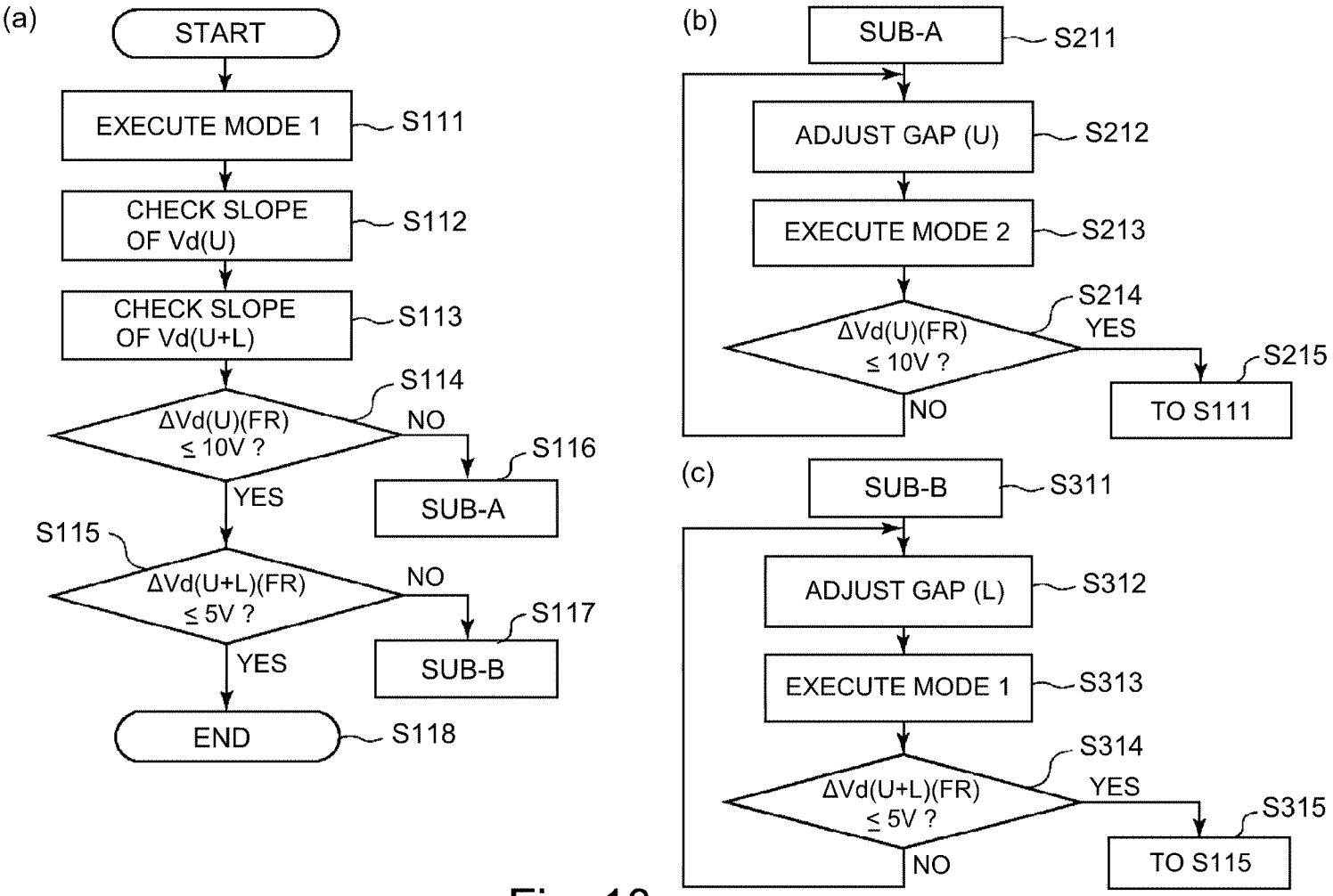
In FIG. 18, (a) to (c) are flowcharts showing another example of the adjusting procedure of the slope of the charge potential.

In FIG. 18, (a) to (c) are flowcharts showing a procedure of adjusting the slope of the charge potential in this embodiment. In the case where the charge potential slope is adjusted, the operator successively carries out measurement of the charge potential slope and adjustment of the charge potential slope in accordance with the procedures shown in (a) to (c) of FIG. 18.

Procedures of S111-S118 of (a) of FIG. 18 are the same as the procedures of S101-S108, respectively, of (a) of FIG. 17 in Embodiment 1. Further, procedures S211-S215 of (b) of FIG. 18 are similar to the procedures of S201-S205, respectively, of (b) of FIG. 17 in Embodiment 1. However, in this embodiment, an adjusting method of the slope of the upstream charge potential Vd(U) in S212 is different from that in S202. Further, procedures of S311-S315 of (c) of FIG. 18 are similar to the procedures of S301-S305, respectively, of (c) of FIG. 17 in Embodiment 1. However, in this embodiment, an adjusting method of the slope of the combined surface potential Vd(U+L) by adjusting the slope of the downstream charge potential Vd(L) in S312 is different from that in S302 in Embodiment 1.

In this embodiment in S212 of (b) of FIG. 18, on the basis of a relationship between the grid gap GAP(U) for the upstream charger 31 and the upstream charge potential Vd(U) shown in FIG. 11, the operator adjusts the grid gap GAP(U) for the upstream charger 31. As a result, the slope of the upstream charge potential Vd(U) is adjusted.

Further, in S312 of (c) of FIG. 18, on the basis of a relationship between the grid gap GAP(L) for the downstream charger 32 and the combined surface potential Vd(U+L) shown in FIG. 11, the operator adjusts the grid gap GAP(L) for the downstream charger 32. As a result, the slope of the combined surface potential Vd(U+L) is adjusted.

In this embodiment, by using the first and second charging modes, the slope of the upstream charge potential Vd(U) formed by the upstream charger 31 in a main charging side and the slope of the combined surface potential Vd(U+L) formed by the upstream charger 31 and the downstream charger 32 can be independently measured. Further, in this embodiment, by using the third adjusting method of the charge potential slope, the charge potential Vd(U) formed by the upstream charger 31 is independently adjusted, so that the potential can be adjusted substantially uniformly with respect to the thrust direction. Further, by independently adjusting the charge potential Vd(L) formed by the downstream charger 32 in a potential convergence side, the combined surface potential Vd(U+L) finally formed can be adjusted substantially uniformly with respect to the thrust direction.

Also in the case of using the third adjusting method as in this embodiment, similarly as described above in Embodiment 1, by using the second and third charging modes, the slope of the upstream charge potential Vd(U) and the slope of the downstream charge potential Vd(L) can be independently measured and adjusted.

Embodiment 3

Another embodiment of the present invention will be described. A basic structure and a basic operation of an image forming apparatus in this embodiment are the same as those in Embodiment 1. Accordingly, elements having the same or corresponding functions or structures as those in Embodiment 1 are represented by the same reference numerals or symbols and will be omitted from detailed description.

In this embodiment, as an adjusting procedure (method) of the slope of the upstream charge potential Vd(U), the second adjusting method described above with reference to FIG. 10 is used. Further, in this embodiment, as an adjusting procedure (method) of the slope of the combined surface potential Vd(U+L) by adjustment of the slope of the downstream charge potential Vd(L), the first adjusting method described above with reference to FIG. 8 is used.

Figure 19:
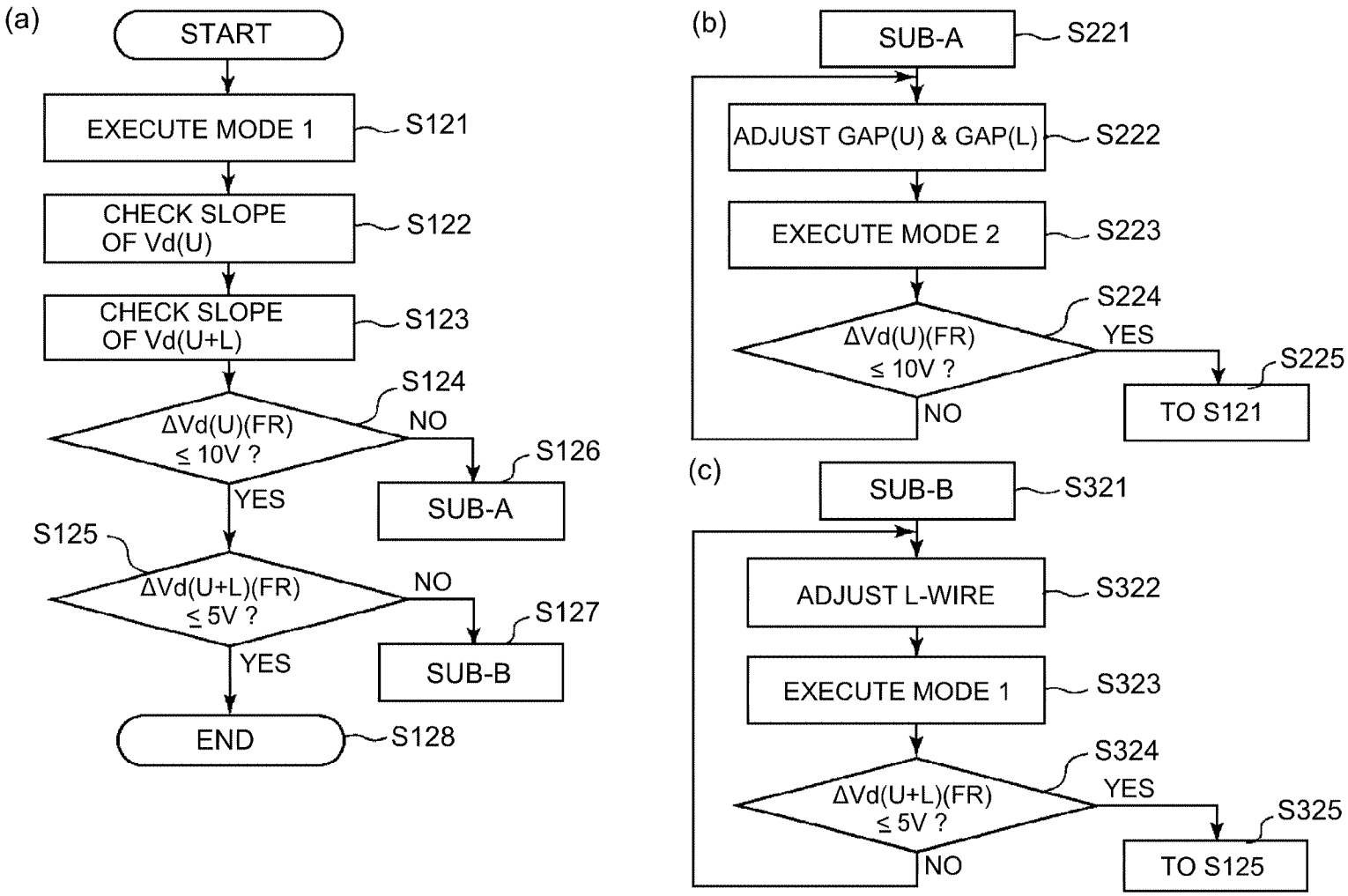
In FIG. 19, (a) to (c) are flowcharts showing another example of the adjusting procedure of the slope of the charge potential.

In FIG. 19, (a) to (c) are flowcharts showing a procedure of adjusting the slope of the charge potential in this embodiment. In the case where the charge potential slope is adjusted, the operator successively carries out measurement of the charge potential slope and adjustment of the charge potential slope in accordance with the procedures shown in (a) to (c) of FIG. 19.

Procedures of S121-S128 of (a) of FIG. 19 are the same as the procedures of S101-S108, respectively, of (a) of FIG. 17 in Embodiment 1. Further, procedures S221-S225 of (b) of FIG. 19 are similar to the procedures of S201-S205, respectively, of (b) of FIG. 17 in Embodiment 1. However, in this embodiment, an adjusting method of the slope of the upstream charge potential Vd(U) in S222 is different from that in S202. Further, procedures of S321-S325 of (c) of FIG. 19 are the same as the procedures of S301-S305, respectively, of (c) of FIG. 17 in Embodiment 1.

In this embodiment in S222 of (b) of FIG. 19, on the basis of a relationship between the grid gap GAP(U) and the upstream charge potential Vd(U) shown in FIG. 11, the operator simultaneously adjusts the grid gap GAP(U) for the upstream charger 31 and the grid gap GAP(L) for the downstream charger 32. As a result, the slope of the upstream charge potential Vd(U) is adjusted.

Further, in S322 of (c) of FIG. 19, similarly as in procedure of S302, the operator adjusts the wire height Hpg(L) of the downstream charger 32.

In this embodiment, by using the first and second charging modes, the slope of the upstream charge potential Vd(U) formed by the upstream charger 31 in a main charging side and the slope of the combined surface potential Vd(U+L) formed by the upstream charger 31 and the downstream charger 32 can be independently measured. Further, in this embodiment, by using the second adjusting method as the adjusting method of the slope of the upstream charge potential Vd(U), the charge potential Vd(U) formed by the upstream charger 31 is independently adjusted, so that the potential can be adjusted substantially uniformly with respect to the thrust direction. Further, during the adjustment of the upstream charge potential Vd(U), fine adjustment of the combined surface potential Vd(U+L) can be carried out simultaneously, so that a time required for adjusting the slope of the charge potential can be shortened. Further, by using the first adjusting method as the adjusting method of the slope of the downstream charge potential Vd(L), the charge potential Vd(L) formed by the downstream charger 32 in a potential convergence side is independently adjusted, so that the combined surface potential Vd(U+L) finally formed can be adjusted substantially uniformly with respect to the thrust direction.

Also in the case of using the first and second adjusting methods as in this embodiment, similarly as described above in Embodiment 1, by using the second and third charging modes, the slope of the upstream charge potential Vd(U) and the slope of the downstream charge potential Vd(L) can be independently measured and adjusted.

In the third adjusting method used in this embodiment, the grid gaps GAP(U) and GAP(L) of the upstream and downstream chargers 31 and 32 were simultaneously adjusted, but in place thereof, the wire heights Hpg(U) and Hpg(L) may also be constituted so as to be capable of being simultaneously adjusted. Further, in the case where the grid gaps GAP(U) and GAP(L) are simultaneously adjusted in the third adjusting method, the grid gap GAP(L) can be made independently adjustable in order to adjust the downstream charge potential Vd(L). For example, the grid gap GAP(L) of the downstream charger 32 can be independently adjusted by independently moving the block 34 of the downstream charger 32 while adjusting the slope of an entirety of the charging device 3.

Embodiment 4

Another embodiment of the present invention will be described. A basic structure and a basic operation of an image forming apparatus in this embodiment are the same as those in Embodiment 1. Accordingly, elements having the same or corresponding functions or structures as those in Embodiment 1 are represented by the same reference numerals or symbols and will be omitted from detailed description.

<1. Outline of this Embodiment>

In Embodiments 1-3, the electrometer for detecting the surface distance of the photosensitive member 1 was mounted at the developing position G, and the slope of the charge potential was measured. On the other hand, in this embodiment, in an operation in a measuring mode, a test image is formed by depositing toner on a portion with a charge potential formed on the photosensitive member 1 and is subjected to measurement of an image density of the test image, and then on the basis of the image density, the slope of the charge potential is acquired. Particularly, in this embodiment, the image density of the test image is measured using the reading portion 250 of the image forming apparatus 100, so that the slope of the image density (charge potential), an adjusting portion (position) of the adjusting mechanism 2 (display of the front side or the rear side) and an adjusting amount of the adjusting mechanism can be displayed at the operating portion 300. As a result, in this embodiment, acquirement of information on the slope of the charge potential is simplified, so that shortening of a time required for adjusting the slope of the charge potential can be realized. The reading portion 250 is an example of an optical detecting member for detecting light, emitted to the test image, at a plurality of positions with respect to the thrust direction.

In this embodiment, the first charging mode is used as the charging mode and the first adjusting method is used as the adjusting method of the slope of the charge potential. However, the method of acquiring the information on the slope of the charge potential by the image density can also be employed in the case where either one of the charging modes and either one of the adjusting methods of the charge potential slope are used.

<2. Setting of Test Image Formation>

First, a setting method of test image formation in the operation in the measuring mode will be described. In this embodiment, similarly as in Embodiments 1-3, the image forming apparatus 100 executes the operation in the measuring mode depending on an instruction by an operator. The operator selects the charging mode through an operating portion 300 when the operation in the measuring mode is executed, so that the test image is formed depending on the selected charging mode.

In the case where the test image is formed in the operation in the measuring mode, the operator switches the image formation selection box 304 of the setting screen shown in FIG. 13 from "NO" to "YES". In the case of "NO" of the image formation selection box 304, the operation in the measuring mode similar to those in Embodiments 1-3 can be executed. The operator selects the charging mode in the charging mode selection box 302. A selecting method of the charging mode is similar to those in Embodiments 1-3. Then, the operator causes the image forming apparatus to carry out formation of the test image depending on the selected charging mode by pressing the start button 301. In this embodiment, the test image is printed (transferred and fixed) on the recording material P and is outputted.

<3. Test Image>

Figure 21:
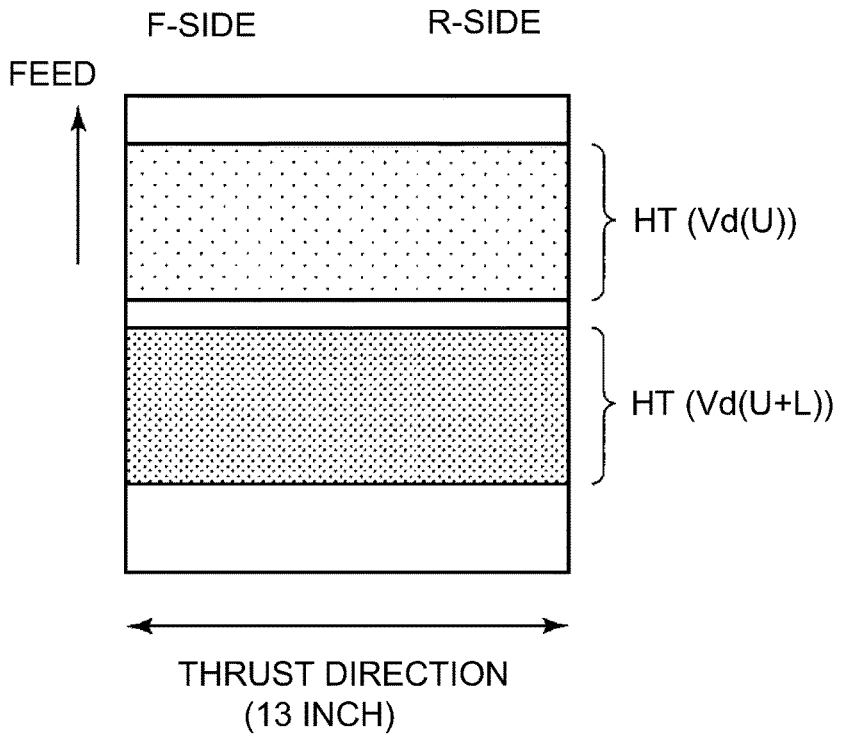
FIG. 21 is a schematic view of a test image for adjusting the slope of the charge potential.

FIG. 21 is a schematic view showing an example of the test image formed in the operation in a first charging mode. This test image is formed on a single recording material of 13 inch×19 inch in size.

In this embodiment, as the test image, a half-tone (HT) image is formed by analog development in which an absolute value of the developing voltage (negative) is set at a value larger than each of the upstream charge potential Vd(U) and the combined surface potential Vd(U+L) by 50 V. The analog development is of a type in which the toner is deposited on the photosensitive member 1 by a potential difference (developing contrast) between the surface potential of the photosensitive member 1 and the developing voltage without carrying out the exposure by the exposure device 10.

As shown in FIG. 21, in the operation in the first charging mode, in the first half portion (leading end side) of the recording material P with respect to a feeding direction of the recording material P, an HT image (first test image) obtained by developing a region of the upstream charge potential Vd(U) is formed. Further, in the second half portion (trailing end side) of the recording material P with respect to the feeding direction, an HT image (second test image) obtained by developing a region of the combined surface potential Vd(U+L) is formed.

In this embodiment, the developing contrast was set at 50 V, but can be arbitrarily set depending on the constitution or the like of the image forming apparatus 100 when the slope of the charge potential is in a density region recognizable as the image density. In this embodiment, the developing contrast was set so that the image density is a HT image density of D=about 0.5 as a level of reflection density.

In the operations in the second and third charging modes, with respect to each of the upstream charge potential Vd(U) and the downstream charge potential Vd(L), for example, similarly as in the case of FIG. 21, the test image is formed by deposition of the toner through the analog development in which the developing contrast is set at 50 V.

<4. Measurement of Slope of Image Density and Display of Adjusting Amount>

In this embodiment, when the operation in the charging mode is selected in the setting screen (FIG. 13) as described above and the test image formation is carried out, by the CPU 200, the display at the operating portion 300 is automatically switched to a result screen shown in FIG. 22. In the result screen, the number ("1", "2" or "3") of the charging mode executed is displayed in a charging mode box 305. The operator sets the outputted test image on the reading portion 250, and causes the reading portion 250 to measure the image density of the test image by pressing a reading start button 306 of the result screen.

The reading portion 250 detects the image density of the test image at a plurality of positions with respect to the thrust direction. The number of the plurality of positions is arbitrary, but in order to measure the charge potential slope with sufficient accuracy, the number of the detecting positions may desirably be two or more positions in the rear side and the front side relative to the central side of the test image with respect to the thrust direction. In this embodiment, the reading portion 250 detects the image density of the test image at the two positions in the rear side and the front side relative to the central side with respect to the thrust direction.

When the reading of the test image by the reading portion 250 is executed as described above, a measurement result acquired by the CPU 200 on the basis of the image density of the detected test image is displayed in a measurement result box 307. In this embodiment, in the measurement result box 307, a measured value of the image density of the test image formed in each of the operations in the charging modes, a slope of the image density (i.e., an image density difference ΔD between the front side and the rear side relative to the central side with respect to the thrust direction), the adjusting portion (position) of the adjusting mechanism 2, and the adjusting amount of the adjusting mechanism 2 are displayed.

The measurement result box 307 will be further described. In a row of an "upstream side", the image density of the test image, in the front side (F side) and the rear side (R side), formed by developing the region of the upstream charge potential Vd(U), the image density difference ΔD, the adjusting portion and the adjusting amount (guide (measure)) of the wire height Hpg(U) in the upstream charger 31 are displayed. In a row of a "combined surface potential", the image density of the test image, in the front side (F side) and the rear side (R side), formed by developing the region of the combined surface potential Vd(U+L), the image density difference ΔD, and the adjusting portion of the adjusting mechanism 2 are displayed. In a row of a "downstream side", as the density difference, a difference between the image density difference D displayed in the row of the "upstream side" and the image density difference ΔD displayed in the row of the "combined surface potential" is displayed, and as the adjusting amount of the adjusting mechanism 2, the adjusting amount (guide (measure)) of the wire height Hpg(L) in the downstream charger 32 is displayed.

FIG. 22 shows an example of the case where the operation in the first charging mode is carried out, but in the case where the operation in the third charging mode is carried out, there is no measurement result to be displayed in the row of the "combined surface potential", and therefore, for example, in the same manner as in the row of the "upstream side", the image density, the image density difference, the adjusting portion and the adjusting amount are displayed.

The constitutions of the display contents and the screens at the operating portion 300 are not limited to the above-described contents and screens, but may also be changed to other constitutions. At least one of the information on the slope of the charge potential and the information on the adjusting amount of the adjusting mechanism 2 may only be required to be displayed. However, it is desirable that at least the image density, the image density difference, the adjusting portion and the adjusting amount of the slope are displayed.

<5. Adjusting Amount>

Next, a relationship between the slope of the image density of the test image and the adjusting amount of the adjusting mechanism 2 (adjusting amount of the wire height Hpg in this embodiment) will be described.

Figure 23:
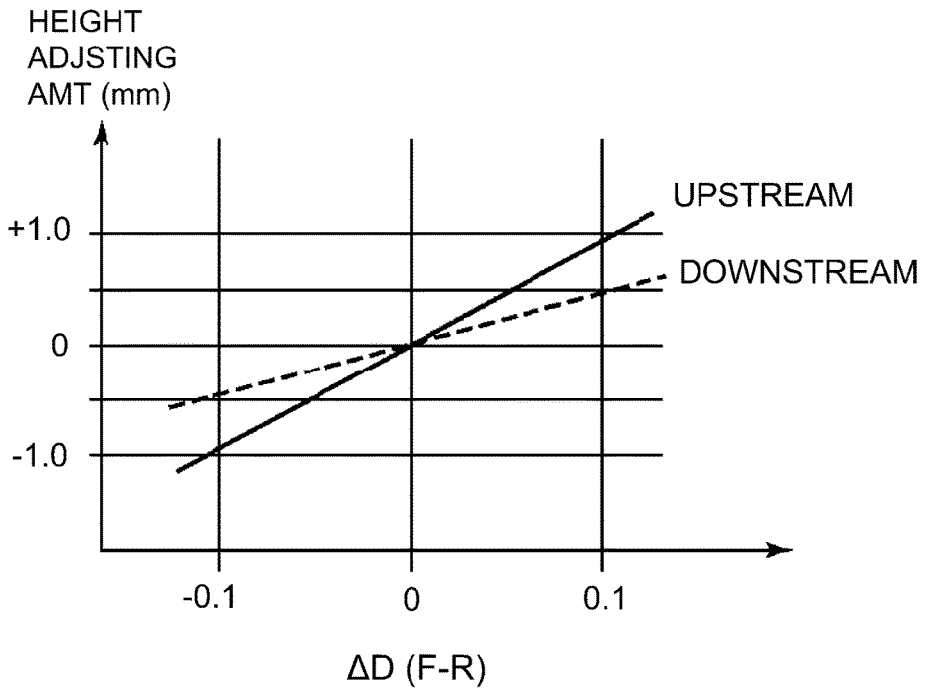
FIG. 23 is a graph showing a relationship between a slope of an image density and an adjusting amount of the wire height.

FIG. 23 is a graph showing a relationship between the adjusting amount of the wire height Hpg and an image density difference ΔD(F-R) between the test images in the front side (F side) and the rear side (roller side). In FIG. 23, an X-axis represents the image density difference Δ(F-R), and in the case of a positive value, the image density in the front side is higher than the image density in the rear side, and in the case of a negative value, the image density in the front side is lower than the image density in the rear side. In FIG. 23, a Y-axis represents the adjusting amount of the wire height Hpg, and in a positive side, the wire height Hpg is increased, and in a negative side, the wire height Hpg is decreased. In FIG. 23, a solid line represents the relationship between the adjusting amount of the wire height Hpg(U) in the upstream charger 31 and the image density difference ΔD in the test image obtained by developing the region of the upstream charge potential Vd(U). In FIG. 23, a broken line represents the relationship between the adjusting amount of the wire height Hpg(L) in the downstream charger 32 and the image density difference ΔD in the test image obtained by developing the region of the combined surface potential Vd(U+L).

On the basis of the image density of the test image read by the reading portion 250, the CPU 200 calculates the direction of the slope of the image density, the adjusting portion (front side or rear side), and the adjusting amount by using the relationship of FIG. 23. Then, the CPU 200 causes the operating portion 300 to display a calculation result in the measurement result box 307 on the result screen shown in FIG. 22. In this embodiment, the adjusting amount for adjusting the potential providing a higher image density so as to coincide with the potential providing a lower image density is displayed.

On the basis of the measurement result displayed on the result screen shown in FIG. 22, the adjustment of the wire heights Hpg(U) and Hpg(L) of the upstream and downstream chargers 31 and 32, respectively, is effected, so that the charge potential of the photosensitive member 1 can be adjusted substantially uniformly with respect to the thrust direction.

<6. Adjusting Procedure of Slope of Charge Potential>

Figure 20:
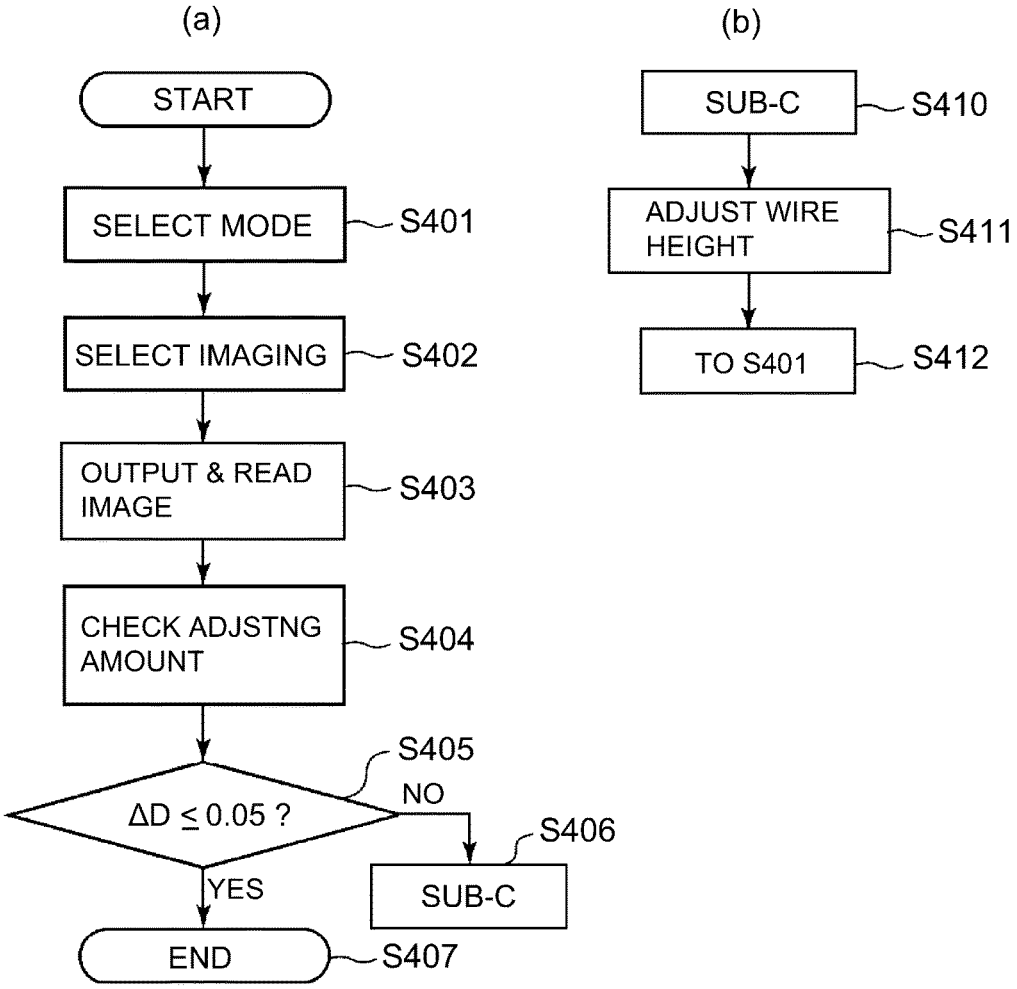
In FIG. 20, (a) and (b) are flowcharts showing a further example of the adjusting procedure of the slope of the charge potential.

Next, a procedure of adjusting the slope of the charge potential of the photosensitive member 1 by executing the operation in the measuring mode in this embodiment will be described. As described above, in this embodiment, as the charging mode, the first charging mode is used, and as an adjusting procedure (method) of the slope of the charge potential, the first adjusting method is used. In FIG. 20, (a) and (b) are flowcharts showing a procedure of adjusting the slope of the charge potential in this embodiment. In the case where the charge potential slope is adjusted, the operator successively carries out measurement of the charge potential slope and adjustment of the charge potential slope in accordance with the procedures shown in (a) and (b) of FIG. 20.

First, the operator selects, in the procedure of (a) of FIG. 20, the first charging mode in the charging mode selection box 302 on the setting screen (FIG. 13) of the operating portion 300 and then switches the image formation selection box 304 to "YES", so that formation of the test image is carried out (S401, S402). As a result, when the test image is outputted, display of the operating portion 300 is switched to the result screen of FIG. 22.

Thereafter, the operator sets the outputted test image on the reading portion 250 and presses a reading start button 306, and causes the reading portion 250 to start reading of the test image (S403). As a result, the test image is read by the reading portion 250, and when the reading ends, the measurement result is displayed on the measurement result box 307 of the result screen as described above. Thereafter, the operator checks the measurement result (S404) and discriminates whether or not the adjustment of the slope of the charge potential is needed (S405). In this embodiment, in the case where the image density difference ΔD in the "combined surface potential" is not more than 0.05, there is no need to correct the slope of the charge potential, and therefore the procedure ends (S407). On the other hand, if the image density difference ΔD is greater than 0.05, the procedure goes to SUB-C of (b) of FIG. 20 (S406, S410).

After the procedure goes to SUB-C of (b) of FIG. 20, the operator carries out the adjustment of the wire heights Hpg(U) and Hpg(L) of the upstream and downstream chargers 31 and 32, respectively, in accordance with the display of the adjusting portion and the adjusting amount in the measurement result box 307 (S411). Thereafter, the operator returns the procedure to the procedure of S401 of (a) of FIG. 20 (S412).

In this embodiment, as the adjusting method of the slope of the image density, the case where the first adjusting method is used was described as an example, but the above-described second adjusting method and the third adjusting method may also be used. Also in the case where either of the adjusting methods is used, the adjusting portion and the adjusting amount are acquired correspondingly to the adjusting method, so that the slope of the charge potential can be adjusted in the same procedure as the above-described procedure.

<7. Formation of Test Image>

Next, with reference to timing charts of (b) of FIG. 14, (b) of FIG. 15 and (b) of FIG. 16, an operation in each of the charging modes in the case where the test image is formed will be described. Incidentally, description of the contents relating to the charging processes described above with reference to (a) of FIG. 14, (a) of FIG. 15 and (a) of FIG. 16 will be omitted.

<7-1. First Charging Mode>

In FIG. 14, (b) is a timing chart in the case where the test image is formed in the operation in the first charging mode.

As shown in (b) of FIG. 14, at timing T1, in synchronism with application of the charge voltage to the upstream charger 31, application of the developing voltage DC(U) is started in order to develop the region of the upstream charge potential Vd(U), and also drive of the developing device 6 is started in synchronism with the charge voltage application. Thereafter, the application of the developing voltage DC(U) is continued during a predetermined time Δt from timing T2 to timing T4 in which the upstream charge potential Vd(U) and the developing voltage are stable. Further, at timing T3 when the toner image reaches the transfer position (transfer portion) N, application of the transfer voltage is started. At this time, the recording material P of 13 inch×19 inch is fed to the transfer position N (not shown).

Then, at timing T4, in synchronism with the application of the charge voltage to the downstream charger 32, the developing voltage is switched to DC(U+L) in order to develop the region of the combined surface potential Vd(U+L). At this time, switching from the developing voltage DC(U) to the developing voltage DC(U+L) is made gradually (stepwisely) as shown in (b) of FIG. 14.

Thereafter, the application of the developing voltage DC(U+L) is continued during a predetermined time Δt from timing T5 to timing T6 in which the combined surface potential Vd(U+L) and the developing voltage are stable, and at the timing T6, the drive of the developing device 6 is stopped. Thereafter, at timing T7, the application of the charge voltage to the upstream charger 31 and the downstream charger 32, the application of the developing voltage and the application of the transfer voltage are stopped, and at timing T8, the drive of the photosensitive member 1 is stopped.

In this embodiment, each of the predetermined times Δt when the upstream charge potential Vd(U) and the combined surface potential Vd(U+L) are formed was set at 300 ms. As a result, on the single recording material P of 13 inch×19 inch, test images obtained by developing the regions of the upstream charge potential Vd(U) and the combined surface potential Vd(U+L) can be formed.

Thus, by forming the test images, the slopes of the upstream charge potential Vd(U) and the combined surface potential Vd(U+L) can be measured as slopes of the image densities of the test images without using a potential measuring jig, so that shortening of the time required for adjusting the charge potential slopes can be realized.

<7-2. Second and Third Charging Modes>

Timing charts in the case where the test images are formed in operations in the second and third modes are shown in (b) of FIG. 15 and (b) of FIG. 16, respectively. As shown in (b) of FIG. 15 and (b) of FIG. 16, in the case where the test images are formed in the operations in the second and third charging modes, the application of the developing voltage and the drive of the developing device 6 are controlled so as to develop the upstream charge potential Vd(U) and the downstream charge potential Vd(L), respectively. Further, as shown in (b) of FIG. 15 and (b) of FIG. 16, in the case where the test images are formed in the second and third charging modes, the transfer voltage is controlled so as to transfer the formed test images (toner images) onto the recording material P. The operations of the respective portions in (b) of FIG. 15 and (b) of FIG. 16 are similar to those in the case of the first charging mode, and therefore, detailed description will be omitted. In the operation in the third charging mode, as shown in (b) of FIG. 16, the developing voltage DC(L) set so as to develop the region of the downstream charge potential Vd(L) is used.

In the case where the test images are formed in the operations in the second and third charging modes, each of the slopes of the upstream charge potential and the downstream charge potential can be singly measured as the slope of the image density of the test image, so that the respective potentials can be independently adjusted.

In the case where the test image is formed in the operation in the second charging mode in accordance with (b) of FIG. 15, the test image including only the portion of the upstream charge potential Vd(U) in the test images shown in FIG. 21 is outputted. Further, in the case where the test image is formed in the operation in the third charging mode in accordance with (b) of FIG. 16, the test image including only the portion of the downstream charge potential Vd(L) in place of the portion of the combined surface potential Vd(U+L) in the test images shown in FIG. 21 is outputted.

<8. Modified Embodiments>

Modified embodiments of this embodiment will be described.

In this embodiment, the method of measuring the charge potential slope as the image density slope was described. Further, the image density slope was described as being measured by the reading portion 250 of the image forming apparatus. However, in the case where the image forming apparatus 100 does not include the reading portion 250, the following measurement can be made. For example, the image density of the outputted test image can be measured using a separately prepared image density measuring device. Then, on the basis of the slope of the image density, the slope of the charge potential can be adjusted using a relationship shown in FIG. 23, for example.

Further, the image density detecting means provided in the image forming apparatus 100 is not limited to the reading portion 250. For example, the image density detecting means may also be a means for detecting the image density of the test image on the recording material, on the intermediary transfer member for secondary transferring the toner image, primary-transferred from the photosensitive member, on the recording material, on the recording material carrying member, or on the recording material before being outputted from the image forming apparatus.

Figure 24:
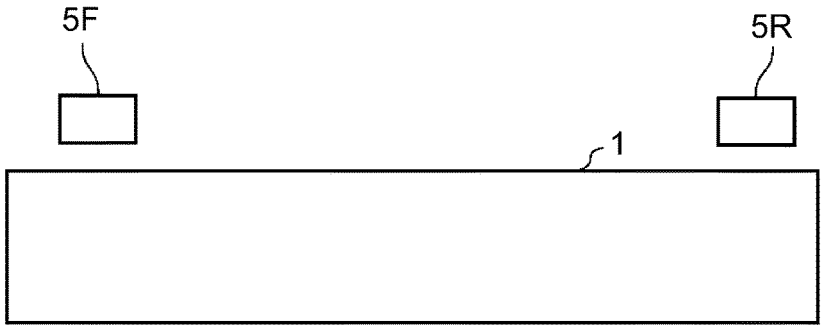
FIG. 24 is a schematic view showing an example of a potential sensor capable of being used for measuring the slope of the charge potential.

Further, in this embodiment, the method of simply adjusting the slope of the charge potential without using the potential measuring jig was described. Particularly, in this embodiment, the charge potential slope was measured as the image density of the test image by the image reading portion 250 of the image forming apparatus 100. As another embodiment, the charge potential slope may also be measured using the potential sensor provided in the image forming apparatus 100, i.e., without separately mounting the potential measuring jig in the image forming apparatus 100. For example, as shown in FIG. 24, inside the apparatus main assembly 110, a plurality (two in an embodiment of FIG. 24) of potential sensors 5F and 5R can be provided so that the surface potential of the photosensitive member 1 can be detected at a plurality of positions with respect to the thrust direction. The potential sensors 5F and 5R are an example of the potential detecting means for detecting the surface potential of the photosensitive member 1 at the plurality of positions with respect to the thrust direction. Then, in the operation in the measuring mode, the test image is not formed and the surface potential of the photosensitive member 1 depending on the charging mode is measured by each of the potential sensors 5F and 5R, and the charge potential slope, the adjusting portion and the adjusting amount are displayed, so that the charge potential slope may also be made adjustable. In this case, it is difficult to dispose the potential sensors 5F and 5R at the developing position G with respect to the rotational direction of the photosensitive member 1. Accordingly, for example, the potential sensors 5F and 5R are disposed at the sensor position D described in Embodiment 1 and control in consideration of a dark decay amount from the sensor position D to the developing position G may only be required to be effected. The potential sensor 5 capable of detecting the surface potential of the photosensitive member 1 by moving the single detecting portion to the plurality of positions with respect to the thrust direction may also be used. Thus, the method of acquiring information on the charge potential slope by the potential sensor provided in the image forming apparatus can be employed in the cases of using either of the charging modes and charge potential slope adjusting methods.

Other Embodiments

In the above, the present invention was described based on specific embodiments, but is not limited to the above-described embodiments.

In the above-described embodiments, the image forming apparatus included the two chargers, but three or more chargers may also be included. In this case, a constitution in which the charge potential by the charger, with the highest charging property, of the plurality of chargers can be independently measured and the charge potential with the charging property relatively lower than the highest charging property of the charger can be independently measured, or a constitution in which the combined surface potential by all of the chargers can be measured may also be employed. For example, the charge potential by the charger with the highest charging property is independently measured. Then, the slope of the charge potential by this charger is adjusted without changing the slopes of the charge potentials by other chargers (the first and third adjusting methods or the like) or also the slopes of the charge potentials by other chargers are simultaneously adjusted (the second adjusting method or the like). Further, the charge potentials by the plurality of chargers relatively lower in charging property than the charger with the highest charging property are independently measured. Then, each of the slopes of the charge potentials by these chargers with the relatively low charging properties is adjusted without changing the slopes of the charge potentials by other chargers (the first and third adjusting method or the like). Further, for example, the charger with the highest charging property is considered as the first charger in the above-described embodiments and the plurality of chargers with the relatively lower charging properties than the charger with the highest charging property is considered as the second charger in the above-described embodiments, and as regards the second charger, the measurement of the charge potential and the adjustment of the slope may also be simultaneously (integrally) carried out. In either of these cases, the charge potential slope can be adjusted on the basis of either of the detection of the potential and the detection of the image density.

In Embodiment 4, the display of the information on the charge potential slope (potential slope, image density slope) and the information on the adjusting amount of the adjusting means at the operating portion of the image forming apparatus was described. On the other hand, the display means for displaying the information can also be constituted by a display portion of an external device such as a computer communicatably connected with the image forming apparatus.

Further, in Embodiment 4, on the basis of the information on the charge potential slope (potential slope, image density) acquired by the image density detecting means or the potential detecting means in the image forming apparatus, the adjustment of the charge potential slope through the adjusting means by the operator in a manual manner was described. On the other hand, on the basis of the information acquired in the image forming apparatus, a constitution in which the charge potential slope is automatically adjusted in the image forming apparatus can also be employed. In this case, for example, the adjusting mechanism having similar function or constitution to that described in the above-described embodiments is driven by the driving means provided in the image forming apparatus. Then, on the basis of the adjusting amount acquired similarly as described in Embodiment 4, the control means may only be required to control the drive of the adjusting mechanism by the driving means.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-157766 filed on Aug. 10, 2016, which is hereby incorporated by reference herein in its entirety.

What is claimed is:

1. An image forming apparatus comprising:

a rotatable photosensitive member;

first and second corona chargers each extending along an axial direction of said photosensitive member at a position opposing said photosensitive member and each configured to electrically charge a surface of said photosensitive member, wherein said second corona charger is disposed downstream of said first corona charger with respect to a rotational direction of said photosensitive member;

an adjusting mechanism provided in each of said first and second corona chargers and capable of adjusting, through an operator, a slope of a charge potential of said photosensitive member with respect to the axial direction;

a developing device provided downstream of said second corona charger with respect to the rotational direction and configured to develop an electrostatic image on said photosensitive member into a toner image with toner deposited on the electrostatic image at a developing position;

a detecting member provided downstream of said second corona charger and upstream of the developing position with respect to the rotational direction and configured to detect a surface potential of said photosensitive member at a plurality of positions with respect to the axial direction;

an input portion to which an instruction of the operator is inputted;

a display portion at which information is displayed; and a controller configured to execute an operation in a first mode and a second mode in accordance with input of the instruction to said input portion, said controller causing said detecting member to detect a first surface potential of said photosensitive member after being charged by said first and second corona chargers and to cause said display portion to display information regarding the first surface potential with respect to the axial direction based on the detection result of said detecting member in the first mode, and said controller causing said detecting member to detect a second surface potential of said photosensitive member after being charged by one of said first corona charger and said second corona charger and causing said display portion to display information regarding the second surface potential with respect to the axial direction based on the detection result of said detecting member in the second mode.

2. The image forming apparatus according to claim 1, further comprising an executing portion causing said display portion to display information on an adjusting amount of said adjusting mechanism on the basis of the detection result.

3. The image forming apparatus according to claim 1, wherein each of said first and second corona chargers includes a discharge electrode, and wherein said adjusting mechanism is constituted so as to be capable of adjusting a distance between said photosensitive member and said discharge electrode of each of said first and second corona chargers at least at one side with respect to the axial direction.

4. The image forming apparatus according to claim 1, wherein each of said first and second corona chargers includes a grid electrode, and wherein said adjusting mechanism is constituted so as to be capable of adjusting a distance between said photosensitive member and said grid electrode of each of said first and second corona chargers at least at one side with respect to the axial direction.

5. The image forming apparatus according to claim 1, wherein each of said first and second corona chargers includes a discharge electrode and a grid electrode, wherein said adjusting mechanism includes a first adjusting mechanism and a second adjusting mechanism, wherein said first adjusting mechanism is constituted so as to be capable of adjusting a distance between said photosensitive member and said discharge electrode of each of said first and second corona chargers at least at one side with respect to the axial direction, and wherein said second adjusting mechanism is constituted so as to be capable of adjusting a distance between said photosensitive member and said grid electrode of each of said first and second corona chargers at least at the one side or at the other side with respect to the axial direction.

6. The image forming apparatus according to claim 1, wherein, in a third mode, said controller causes said detecting member to detect a third surface potential of said photosensitive member after being charged by the other of said first and second corona chargers and causes said display portion to display the information regarding the third surface potential with respect to the axial direction based on the detection result of said detecting member.

7. The image forming apparatus according to claim 1, wherein an absolute value of a charge potential of said photosensitive member charged by said first corona charger is greater than the absolute value of the charge potential charged by said second corona charger when a combined charge potential is formed, and said detecting portion detects the second surface potential of said photosensitive member after being charged by said first corona charger.

* * * * *